US008855341B2

(12) United States Patent
Kim et al.

(10) Patent No.: US 8,855,341 B2
(45) Date of Patent: Oct. 7, 2014

(54) SYSTEMS, METHODS, APPARATUS, AND COMPUTER-READABLE MEDIA FOR HEAD TRACKING BASED ON RECORDED SOUND SIGNALS

(75) Inventors: Lae-Hoon Kim, San Diego, CA (US); Pei Xiang, San Diego, CA (US); Erik Visser, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 464 days.

(21) Appl. No.: 13/280,203

(22) Filed: Oct. 24, 2011

(65) Prior Publication Data

US 2012/0128166 A1 May 24, 2012

Related U.S. Application Data

(60) Provisional application No. 61/406,396, filed on Oct. 25, 2010.

(51) Int. Cl.

| | |
|---|---|
| ***H04R 5/02*** | (2006.01) |
| ***H04R 29/00*** | (2006.01) |
| ***H04R 3/00*** | (2006.01) |
| ***H04R 3/12*** | (2006.01) |
| ***H04R 5/033*** | (2006.01) |
| *H04S 7/00* | (2006.01) |
| *H04R 1/10* | (2006.01) |

(52) U.S. Cl.

CPC ..... *H04R 3/005* (2013.01); *H04S 2420/03* (2013.01); *H04R 2201/107* (2013.01); *H04R 3/12* (2013.01); *H04S 7/303* (2013.01); *H04R 5/033* (2013.01); *H04R 1/1066* (2013.01); *H04R 1/1041* (2013.01); *H04S 2400/15* (2013.01); *H04S 7/304* (2013.01); *H04R 1/1075* (2013.01); *H04R 2201/403* (2013.01); *H04R 2420/01* (2013.01); *H04R 2420/05* (2013.01); *H04R 2499/11* (2013.01); *H04R 2430/21* (2013.01); *H04R 1/1083* (2013.01)

USPC ..... 381/310; 381/58; 381/122; 381/309

(58) Field of Classification Search

CPC ..... H04S 1/005; H04S 7/303; H04S 7/304

USPC ..... 381/309, 310, 58, 56, 92, 122

See application file for complete search history.

(56) References Cited

U.S. PATENT DOCUMENTS 5,987,142 A 11/1999 Courneau et al.
6,005,610 A 12/1999 Pingali (Continued)

FOREIGN PATENT DOCUMENTS

JP 07095698 4/1995
JP 2002135898 A 5/2002

(Continued)

OTHER PUBLICATIONS

International Search Report and Written Opinion—PCT/US2011/057725—ISA/EPO—May 3, 2012.

(Continued)

*Primary Examiner* — Vivian Chin
*Assistant Examiner* — Douglas Suthers
(74) *Attorney, Agent, or Firm* — Austin Rapp & Hardman

(57) ABSTRACT

Systems, methods, apparatus, and machine-readable media for detecting head movement based on recorded sound signals are described.

49 Claims, 25 Drawing Sheets

(56) References Cited

U.S. PATENT DOCUMENTS

| | | | | |
|---|---|---|---|---|
| 6,507,659 | B1 | 1/2003 | Iredale et al. | |
| 7,327,852 | B2 | 2/2008 | Ruwisch | |
| 2002/0167862 | A1 | 11/2002 | Tomasi et al. | |
| 2003/0118197 | A1 | 6/2003 | Nagayasu et al. | |
| 2005/0147257 | A1 | 7/2005 | Melchior et al. | |
| 2005/0226437 | A1 * | 10/2005 | Pellegrini et al. | 381/77 |
| 2006/0045294 | A1 | 3/2006 | Smyth | |
| 2006/0195324 | A1 | 8/2006 | Birk et al. | |
| 2008/0192968 | A1 | 8/2008 | Ho et al. | |
| 2008/0247565 | A1 | 10/2008 | Elko et al. | |
| 2009/0164212 | A1 | 6/2009 | Chan et al. | |
| 2010/0046770 | A1 | 2/2010 | Chan et al. | |
| 2010/0098258 | A1 | 4/2010 | Thorn | |
| 2011/0033063 | A1 | 2/2011 | McGrath et al. | |
| 2011/0038489 | A1 | 2/2011 | Visser et al. | |
| 2012/0128160 | A1 | 5/2012 | Kim et al. | |
| 2012/0128175 | A1 | 5/2012 | Visser et al. | |

FOREIGN PATENT DOCUMENTS

| | | | |
|---|---|---|---|
| JP | 2005176138 | A | 6/2005 |
| JP | 2007266754 | A | 10/2007 |
| JP | 2008512015 | A | 4/2008 |
| JP | 2010128952 | A | 6/2010 |
| KR | 19990076219 | | 10/1999 |
| KR | 20090131237 | A | 12/2009 |

OTHER PUBLICATIONS

ISA/EPO—Mar. 5, 2012.

* cited by examiner

SYSTEMS, METHODS, APPARATUS, AND COMPUTER-READABLE MEDIA FOR HEAD TRACKING BASED ON RECORDED SOUND SIGNALS

CLAIM OF PRIORITY UNDER 35 U.S.C. §119

The present application for patent claims priority to Provisional Application No. 61/406,396, entitled "THREE-DIMENSIONAL SOUND CAPTURING AND REPRODUCING WITH MULTI-MICROPHONES," filed Oct. 25, 2010, and assigned to the assignee hereof.

CROSS REFERENCED APPLICATIONS

The present application for patent is related to the following co-pending U.S. patent applications:

"SYSTEMS, METHODS, APPARATUS, AND COMPUTER-READABLE MEDIA FOR ORIENTATION-SENSITIVE RECORDING CONTROL" Ser. No. 13/280,211, filed concurrently herewith, assigned to the assignee hereof; and "THREE-DIMENSIONAL SOUND CAPTURING AND REPRODUCING WITH MULTI-MICROPHONES", Ser. No. 13/280,303, filed concurrently herewith, assigned to the assignee hereof.

BACKGROUND

1. Field

This disclosure relates to audio signal processing.

2. Background

Three-dimensional audio reproducing has been performed with use of either a pair of headphones or a loudspeaker array. However, existing methods lack on-line controllability, such that the robustness of reproducing an accurate sound image is limited.

A stereo headset by itself typically cannot provide as rich a spatial image as an external loudspeaker array. In the case of headphone reproduction based on a head-related transfer function (HRTF), for example, the sound image is typically localized within the user's head. As a result, the user's perception of depth and spaciousness may be limited.

In the case of an external loudspeaker array, however, the image may be limited to a relatively small sweet spot. The image may also be affected by the position and orientation of the user's head relative to the array.

SUMMARY

A method of audio signal processing according to a general configuration includes calculating a first cross-correlation between a left microphone signal and a reference microphone signal and calculating a second cross-correlation between a right microphone signal and the reference microphone signal. This method also includes determining a corresponding orientation of a head of a user, based on information from the first and second calculated cross-correlations. In this method, the left microphone signal is based on a signal produced by a left microphone located at a left side of the head, the right microphone signal is based on a signal produced by a right microphone located at a right side of the head opposite to the left side, and the reference microphone signal is based on a signal produced by a reference microphone. In this method, the reference microphone is located such that (A) as the head rotates in a first direction, a left distance between the left microphone and the reference microphone decreases and a right distance between the right microphone and the reference microphone increases and (B) as the head rotates in a second direction opposite to the first direction, the left distance increases and the right distance decreases. Computer-readable storage media (e.g., non-transitory media) having tangible features that cause a machine reading the features to perform such a method are also disclosed.

An apparatus for audio signal processing according to a general configuration includes means for calculating a first cross-correlation between a left microphone signal and a reference microphone signal, and means for calculating a second cross-correlation between a right microphone signal and the reference microphone signal. This apparatus also includes means for determining a corresponding orientation of a head of a user, based on information from the first and second calculated cross-correlations. In this apparatus, the left microphone signal is based on a signal produced by a left microphone located at a left side of the head, the right microphone signal is based on a signal produced by a right microphone located at a right side of the head opposite to the left side, and the reference microphone signal is based on a signal produced by a reference microphone. In this apparatus, the reference microphone is located such that (A) as the head rotates in a first direction, a left distance between the left microphone and the reference microphone decreases and a right distance between the right microphone and the reference microphone increases and (B) as the head rotates in a second direction opposite to the first direction, the left distance increases and the right distance decreases.

An apparatus for audio signal processing according to another general configuration includes a left microphone configured to be located, during use of the apparatus, at a left side of a head of a user and a right microphone configured to be located, during use of the apparatus, at a right side of the head opposite to the left side. This apparatus also includes a reference microphone configured to be located, during use of the apparatus, such that (A) as the head rotates in a first direction, a left distance between the left microphone and the reference microphone decreases and a right distance between the right microphone and the reference microphone increases and (B) as the head rotates in a second direction opposite to the first direction, the left distance increases and the right distance decreases. This apparatus also includes a first cross-correlator configured to calculate a first cross-correlation between a reference microphone signal that is based on a signal produced by the reference microphone and a left microphone signal that is based on a signal produced by the left microphone; a second cross-correlator configured to calculate a second cross-correlation between the reference microphone signal and a right microphone signal that is based on a signal produced by the right microphone; and an orientation calculator configured to determine a corresponding orientation of a head of a user, based on information from the first and second calculated cross-correlations.

DETAILED DESCRIPTION

Figure 1B:
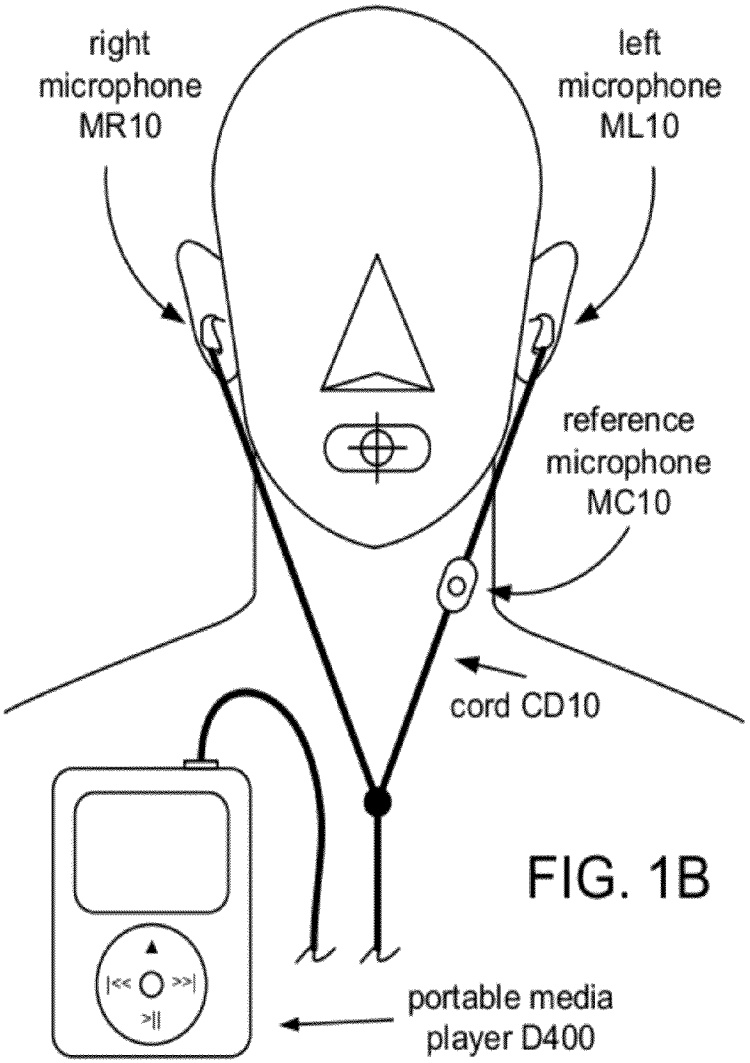
FIG. 1B shows a pair of earbuds.

Nowadays we are experiencing prompt exchange of individual information through rapidly growing social network services such as Facebook, Twitter, etc. At the same time, we also see the distinguishable growth of network speed and storage, which already supports not only text, but also multimedia data. In this environment, we see an important need for capturing and reproducing three-dimensional (3D) audio for more realistic and immersive exchange of individual aural experiences. This disclosure describes several unique features for robust and faithful sound image reconstruction based on a multi-microphone topology.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The terms "coder," "codec," and "coding system" are used interchangeably to denote a system that includes at least one encoder configured to receive and encode frames of an audio signal (possibly after one or more pre-processing operations, such as a perceptual weighting and/or other filtering operation) and a corresponding decoder configured to produce decoded representations of the frames. Such an encoder and decoder are typically deployed at opposite terminals of a communications link. In order to support a full-duplex communication, instances of both of the encoder and the decoder are typically deployed at each end of such a link.

In this description, the term "sensed audio signal" denotes a signal that is received via one or more microphones, and the term "reproduced audio signal" denotes a signal that is reproduced from information that is retrieved from storage and/or received via a wired or wireless connection to another device. An audio reproduction device, such as a communications or playback device, may be configured to output the reproduced audio signal to one or more loudspeakers of the device. Alternatively, such a device may be configured to output the reproduced audio signal to an earpiece, other headset, or external loudspeaker that is coupled to the device via a wire or wirelessly. With reference to transceiver applications for voice communications, such as telephony, the sensed audio signal is the near-end signal to be transmitted by the transceiver, and the reproduced audio signal is the far-end signal received by the transceiver (e.g., via a wireless communications link). With reference to mobile audio reproduction applications, such as playback of recorded music, video, or speech (e.g., MP3-encoded music files, movies, video clips, audiobooks, podcasts) or streaming of such content, the reproduced audio signal is the audio signal being played back or streamed.

A method as described herein may be configured to process the captured signal as a series of segments. Typical segment lengths range from about five or ten milliseconds to about forty or fifty milliseconds, and the segments may be overlapping (e.g., with adjacent segments overlapping by 25% or 50%) or nonoverlapping. In one particular example, the signal is divided into a series of nonoverlapping segments or "frames", each having a length of ten milliseconds. In another particular example, each frame has a length of twenty milliseconds. A segment as processed by such a method may also be a segment (i.e., a "subframe") of a larger segment as processed by a different operation, or vice versa.

A system for sensing head orientation as described herein includes a microphone array having a left microphone ML10 and a right microphone MR10. The microphones are worn on the user's head to move with the head. For example, each microphone may be worn on a respective ear of the user to move with the ear. During use, microphones ML10 and MR10 are typically spaced about fifteen to twenty-five centimeters apart (the average spacing between a user's ears is 17.5 centimeters) and within five centimeters of the opening to the ear canal. It may be desirable for the array to be worn such that an axis of the array (i.e., a line between the centers of microphones ML10 and MR10) rotates with the head.

Figure 1A:
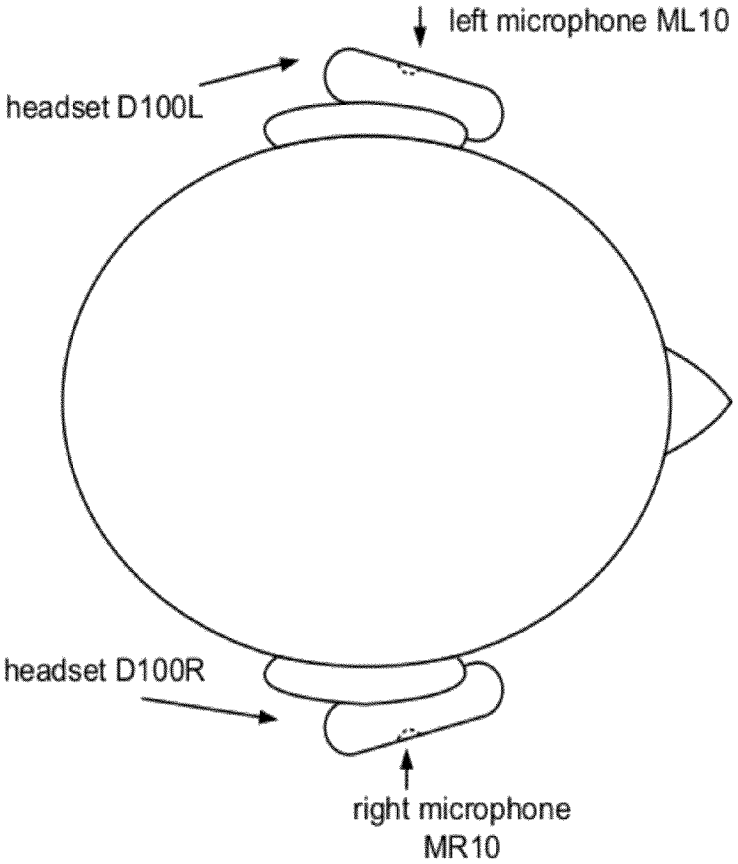
FIG. 1A shows an example of a pair of headsets D100L, D100R.
Figure 2B:
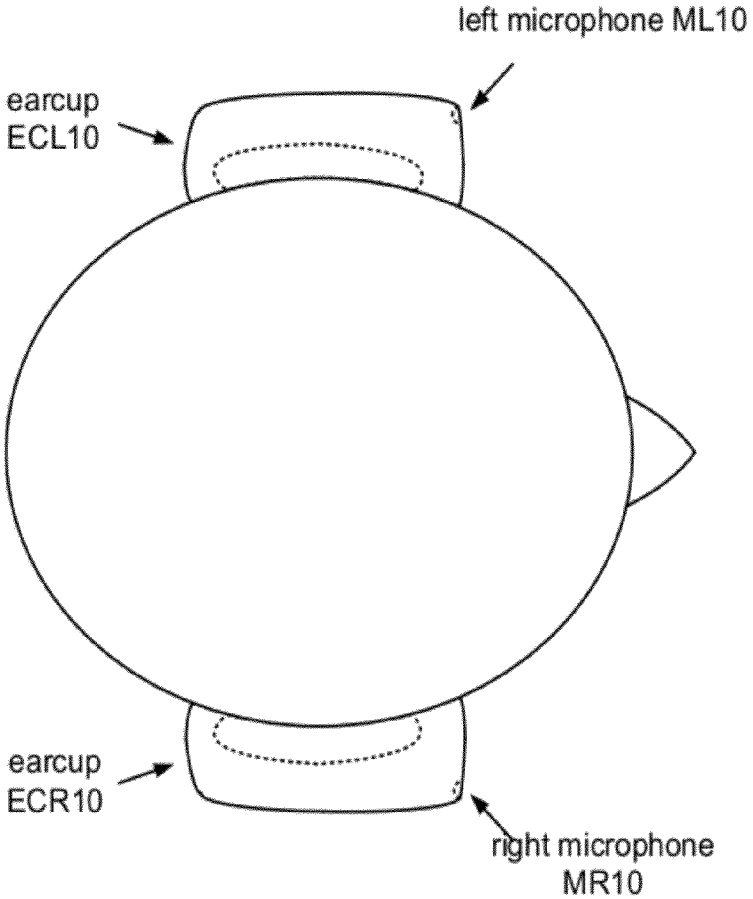
FIGS. 2A and 2B show front and top views, respectively, of a pair of earcups ECL10, ECR10.
Figure 2A:
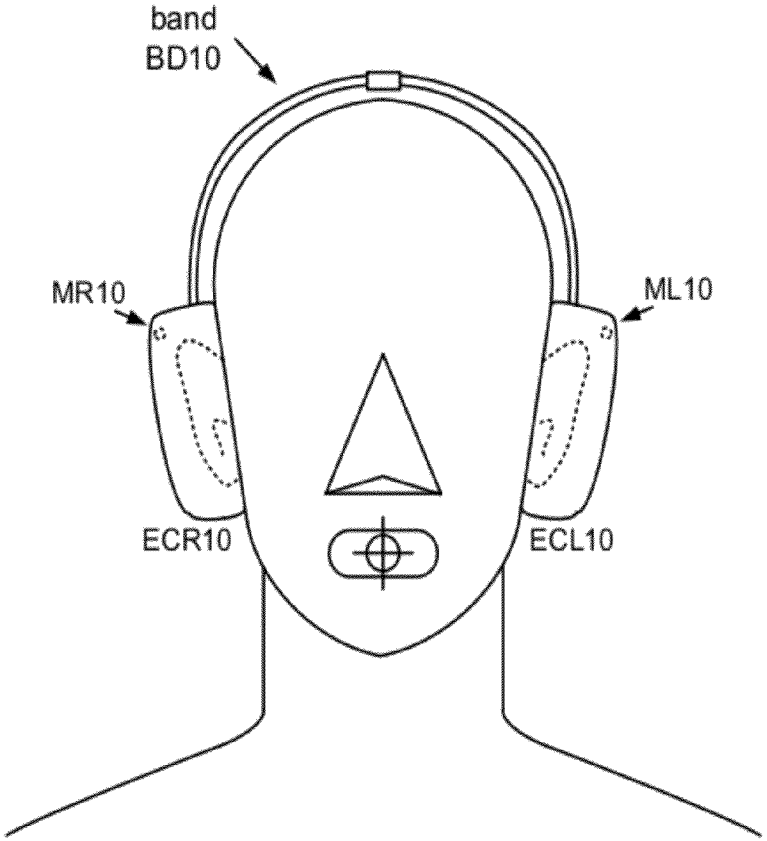
Figure 4B:
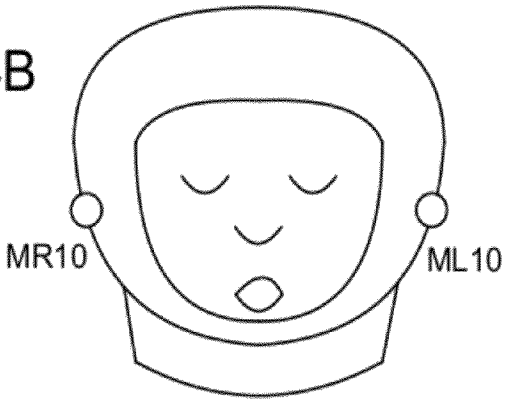
FIG. 4B shows an example of an instance of array ML10-MR10 mounted on a helmet.
Figure 4A:
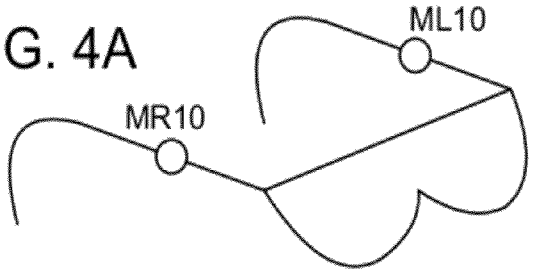
FIG. 4A shows an example of an instance of array ML10-MR10 mounted on a pair of eyewear.

FIG. 1A shows an example of a pair of headsets D100L, D100R that includes an instance of microphone array ML10-MR10. FIG. 1B shows a pair of earbuds that includes an instance of microphone array ML10-MR10. FIGS. 2A and 2B show front and top views, respectively, of a pair of earcups (i.e., headphones) ECL10, ECR10 that includes an instance of microphone array ML10-MR10 and band BD10 that connects the two earcups. FIG. 4A shows an example of an instance of array ML10-MR10 mounted on a pair of eyewear (e.g., eyeglasses, goggles), and FIG. 4B shows an example of an instance of array ML10-MR10 mounted on a helmet.

Uses of such a multi-microphone array may include reduction of noise in a near-end communications signal (e.g., the user's voice), reduction of ambient noise for active noise cancellation (ANC), and/or equalization of a far-end communications signal (e.g., as described in Visser et al., U.S. Publ. Pat. Appl. No. 2010/0017205). It is possible for such an array to include additional head-mounted microphones for redundancy, better selectivity, and/or to support other directional processing operations.

It may be desirable to use such a microphone pair ML10-MR10 in a system for head tracking. This system also includes a reference microphone MC10, which is located such that rotation of the user's head causes one of microphones ML10 and MR10 to move closer to reference microphone MC10 and the other to move away from reference microphone MC10. Reference microphone MC10 may be located, for example, on a cord (e.g., on cord CD10 as shown in FIG. 1B) or on a device that may be held or worn by the user or may be resting on a surface near the user (e.g., on a cellular telephone handset, a tablet or laptop computer, or a portable media player D400 as shown in FIG. 1B). It may be desirable but is not necessary for reference microphone MC10 to be close to a plane described by left and right microphones ML10, MR10 as the head rotates.

Such a multiple-microphone setup may be used to perform head tracking by calculating the acoustic relations between these microphones. Head rotation tracking may be performed, for example, by real-time calculation of the acoustic cross-correlations between microphone signals that are based on the signals produced by these microphones in response to an external sound field.

Figure 3A:
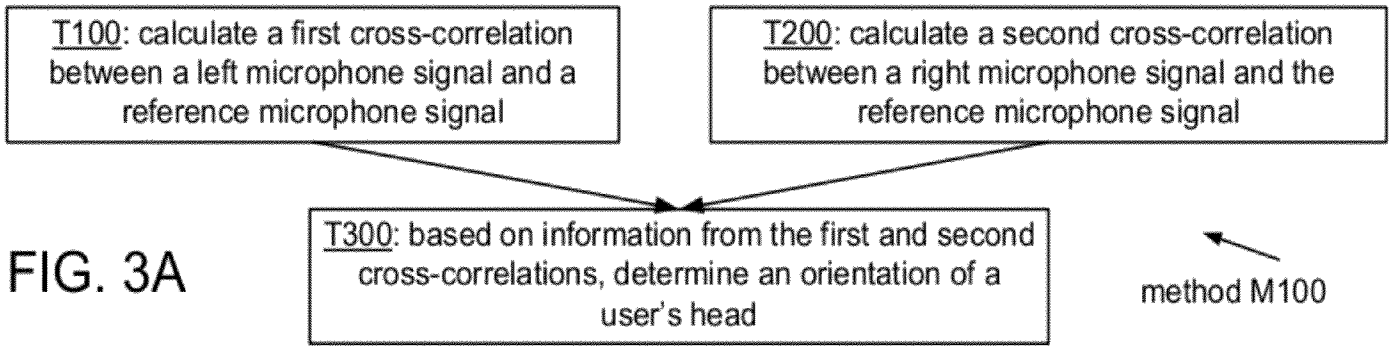
FIG. 3A shows a flowchart of a method M100 according to a general configuration.

FIG. 3A shows a flowchart of a method M100 according to a general configuration that includes tasks T100, T200, and T300. Task T100 calculates a first cross-correlation between a left microphone signal and a reference microphone signal. Task T200 calculates a second cross-correlation between a right microphone signal and the reference microphone signal. Based on information from the first and second calculated cross-correlations, task T300 determines a corresponding orientation of a head of a user.

In one example, task T100 is configured to calculate a time-domain cross-correlation of the reference and left microphone signals $r_{CL}$. For example, task T100 may be implemented to calculate the cross-correlation according to an expression such as $$r_{CL}(d) = \sum_{n=N_1}^{N_2} x_C(n)x_L(n-d),$$

where $x_C$ denotes the reference microphone signal, $x_L$ denotes the left microphone signal, n denotes a sample index, d denotes a delay index, and $N_1$ and $N_2$ denote the first and last samples of the range (e.g., the first and last samples of the current frame). Task T200 may be configured to calculate a time-domain cross-correlation of the reference and right microphone signals $r_{CR}$ according to a similar expression.

In another example, task T100 is configured to calculate a frequency-domain cross-correlation of the reference and left microphone signals $R_{CL}$. For example, task T100 may be implemented to calculate the cross-correlation according to an expression such as $$R_{CL}(k)=X_C(k)X_L^*(k),$$

where $X_C$ denotes the DFT of the reference microphone signal and $X_L$ denotes the DFT of the left microphone signal (e.g., over the current frame), k denotes a frequency bin index, and the asterisk denotes the complex conjugate operation. Task T200 may be configured to calculate a frequency-domain cross-correlation of the reference and right microphone signals $R_{CR}$ according to a similar expression.

Task T300 may be configured to determine the orientation of the user's head based on information from these cross-correlations over a corresponding time. In the time domain, for example, the peak of each cross-correlation indicates the delay between the arrival of the wavefront of the sound field at reference microphone MC10 and its arrival at the corresponding one of microphones ML10 and MR10. In the frequency domain, the delay for each frequency component k is indicated by the phase of the corresponding element of the cross-correlation vector.

Figure 4C:
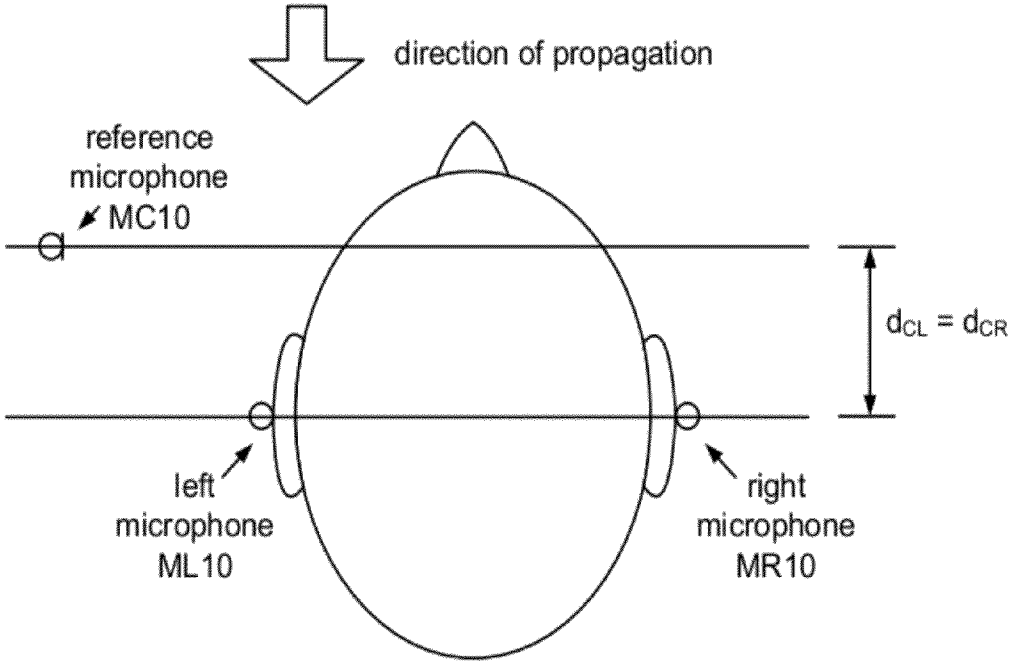
FIGS. 4C, 5, and 6 show top views of examples of the orientation of the axis of the array ML10-MR10 relative to a direction of propagation.
Figure 5:
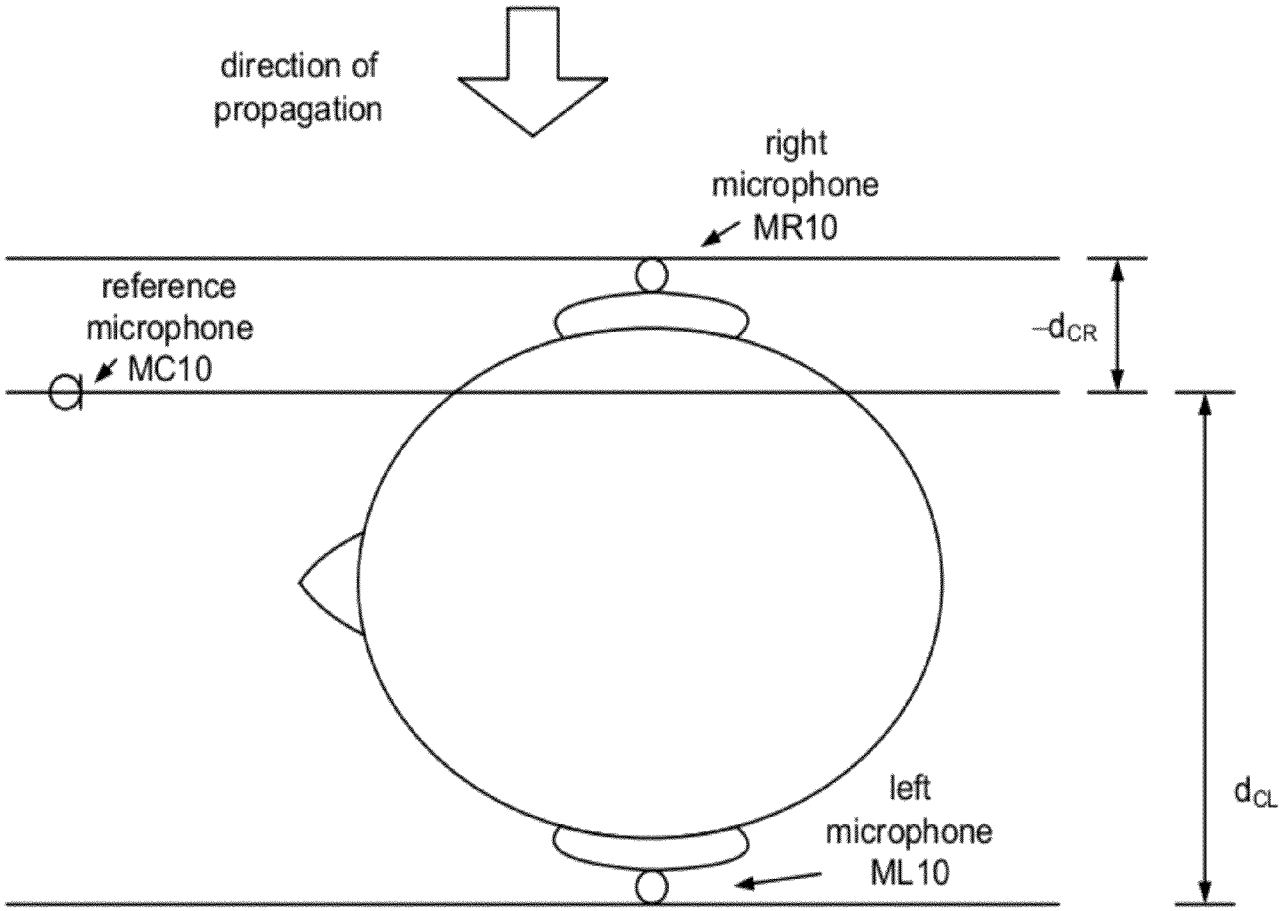
Figure 6:
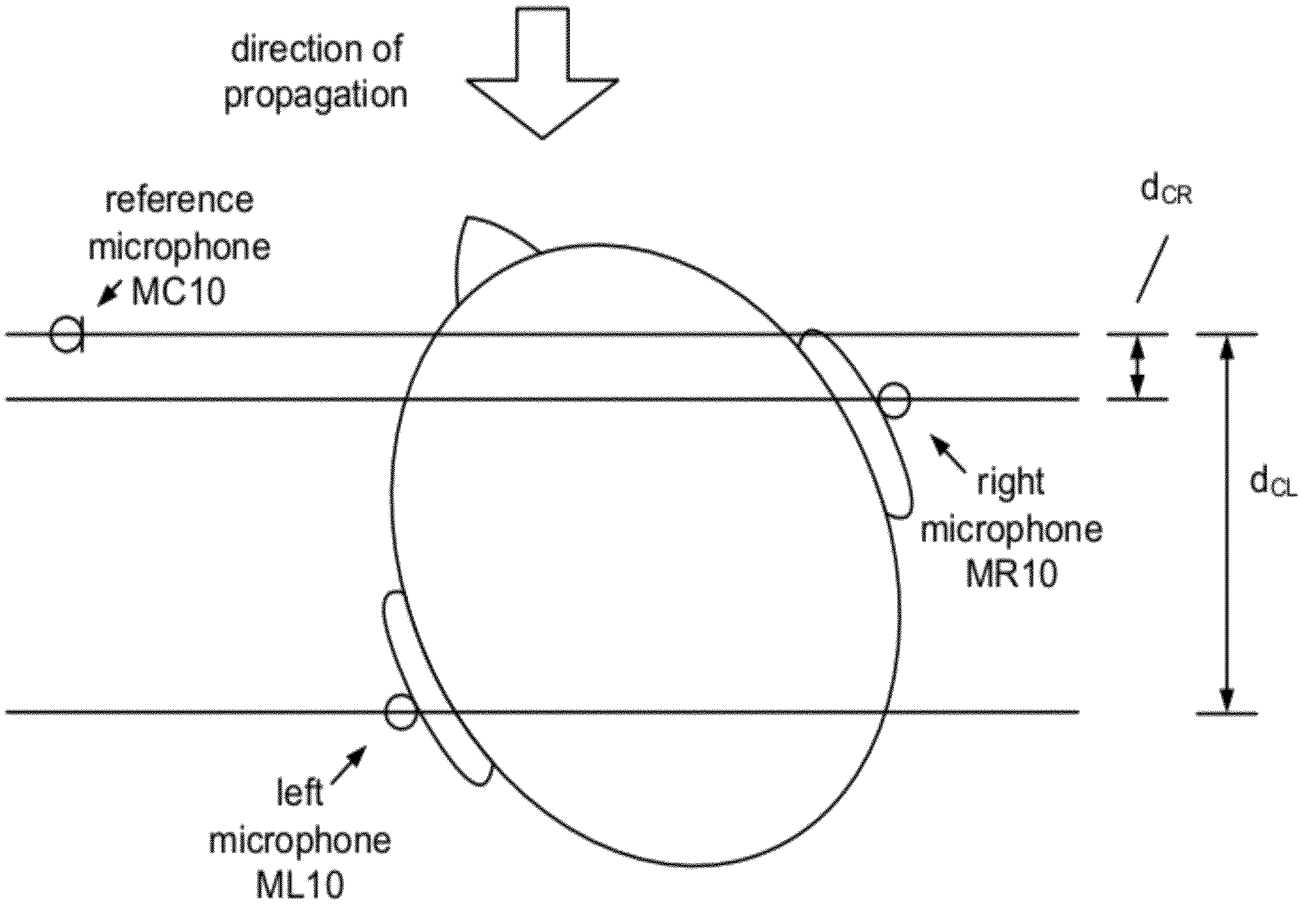

It may be desirable to configure task T300 to determine the orientation relative to a direction of propagation of an ambient sound field. A current orientation may be calculated as the angle between the direction of propagation and the axis of the array ML10-MR10. This angle may be expressed as the inverse cosine of the normalized delay difference NDD= $(d_{CL}-d_{CR})$/LRD, where $d_{CL}$ denotes the delay between the arrival of the wavefront of the sound field at reference microphone MC10 and its arrival at left microphone ML10, $d_{CR}$ denotes the delay between the arrival of the wavefront of the sound field at reference microphone MC10 and its arrival at right microphone MR10, and left-right distance LRD denotes the distance between microphones ML10 and MR10. FIGS. 4C, 5, and 6 show top views of examples in which the orientation of the axis of the array ML10-MR10 relative to a direction of propagation is ninety degrees, zero degrees, and about forty-five degrees, respectively.

Figure 3B:
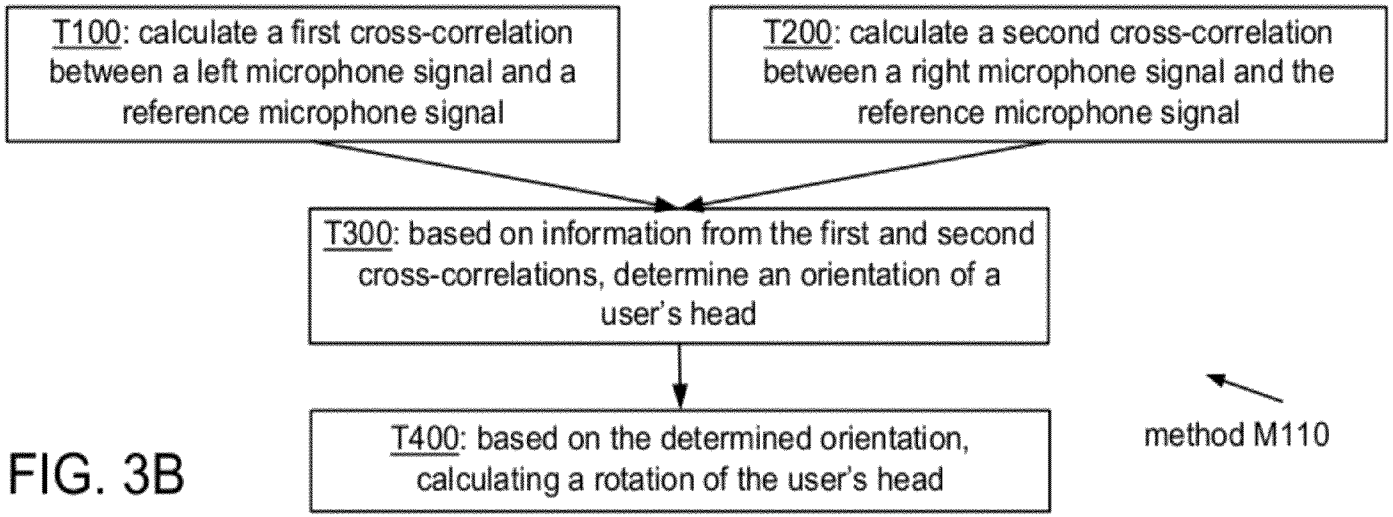
FIG. 3B shows a flowchart of an implementation M110 of method M100.

FIG. 3B shows a flowchart of an implementation M110 of method M100. Method M110 includes task T400 that calculates a rotation of the user's head, based on the determined orientation. Task T400 may be configured to calculate a relative rotation of the head as the angle between two calculated orientations. Alternatively or additionally, task T400 may be configured to calculate an absolute rotation of the head as the angle between a calculated orientation and a reference orientation. A reference orientation may be obtained by calculating the orientation of the user's head when the user is facing in a known direction. In one example, it is assumed that an orientation of the user's head that is most persistent over time is a facing-forward reference orientation (e.g., especially for a media viewing or gaming application). For a case in which reference microphone MC10 is located along the midsagittal plane of the user's body, rotation of the user's head may be tracked unambiguously across a range of +/− ninety degrees relative to a facing-forward orientation.

For a sampling rate of 8 kHz and a speed of sound of 340 m/s, each sample of delay in the time-domain cross-correlation corresponds to a distance of 4.25 cm. For a sampling rate of 16 kHz, each sample of delay in the time-domain cross-correlation corresponds to a distance of 2.125 cm. Subsample resolution may be achieved in the time domain by, for example, including a fractional sample delay in one of the microphone signals (e.g., by sinc interpolation). Subsample resolution may be achieved in the frequency domain by, for example, including a phase shift $e^{-jk\tau}$ in one of the frequency-domain signals, where j is the imaginary number and $\tau$ is a time value that may be less than the sampling period.

Figure 18:
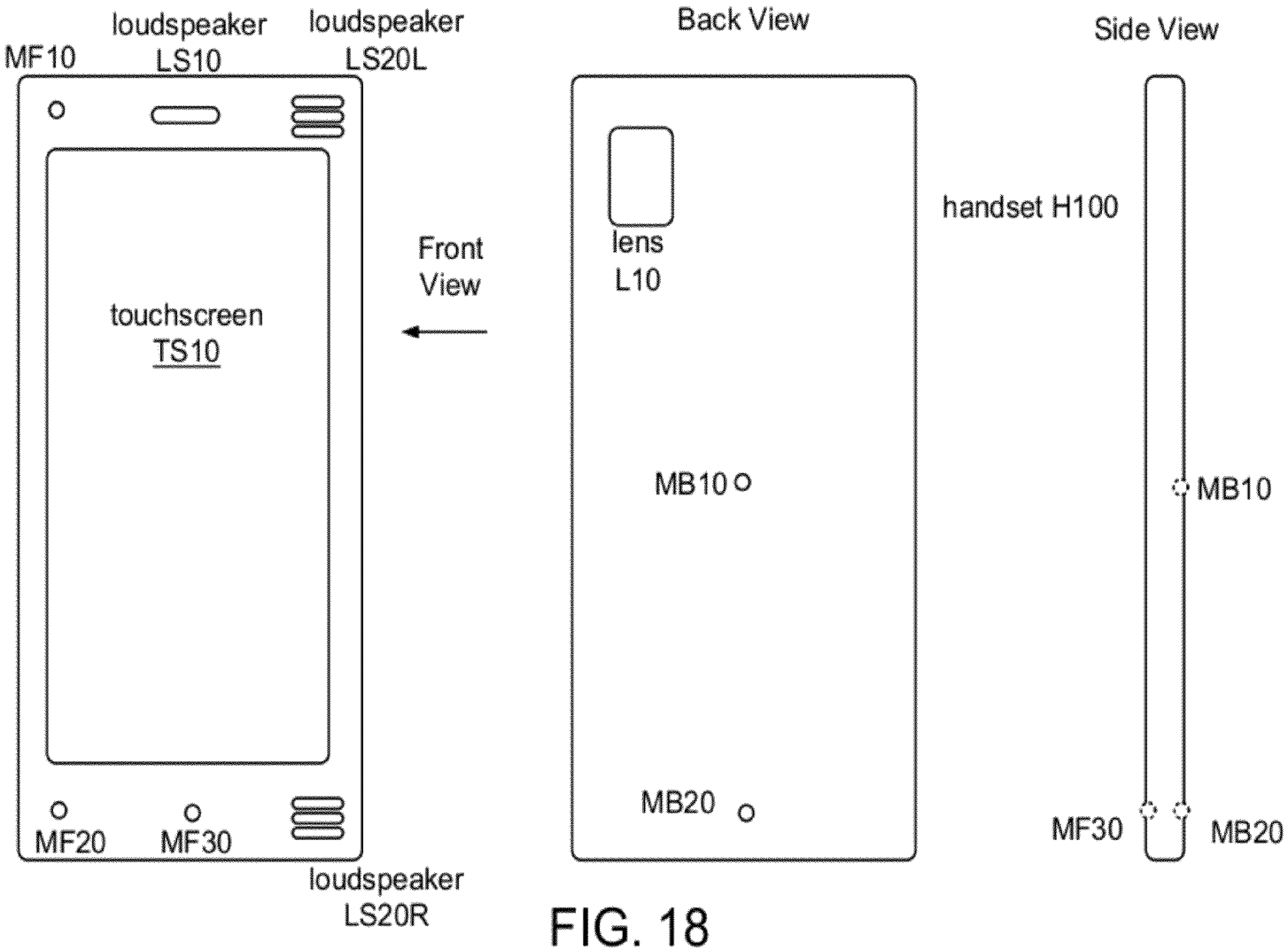
FIG. 18 shows several views of a handset H100.
Figure 19:
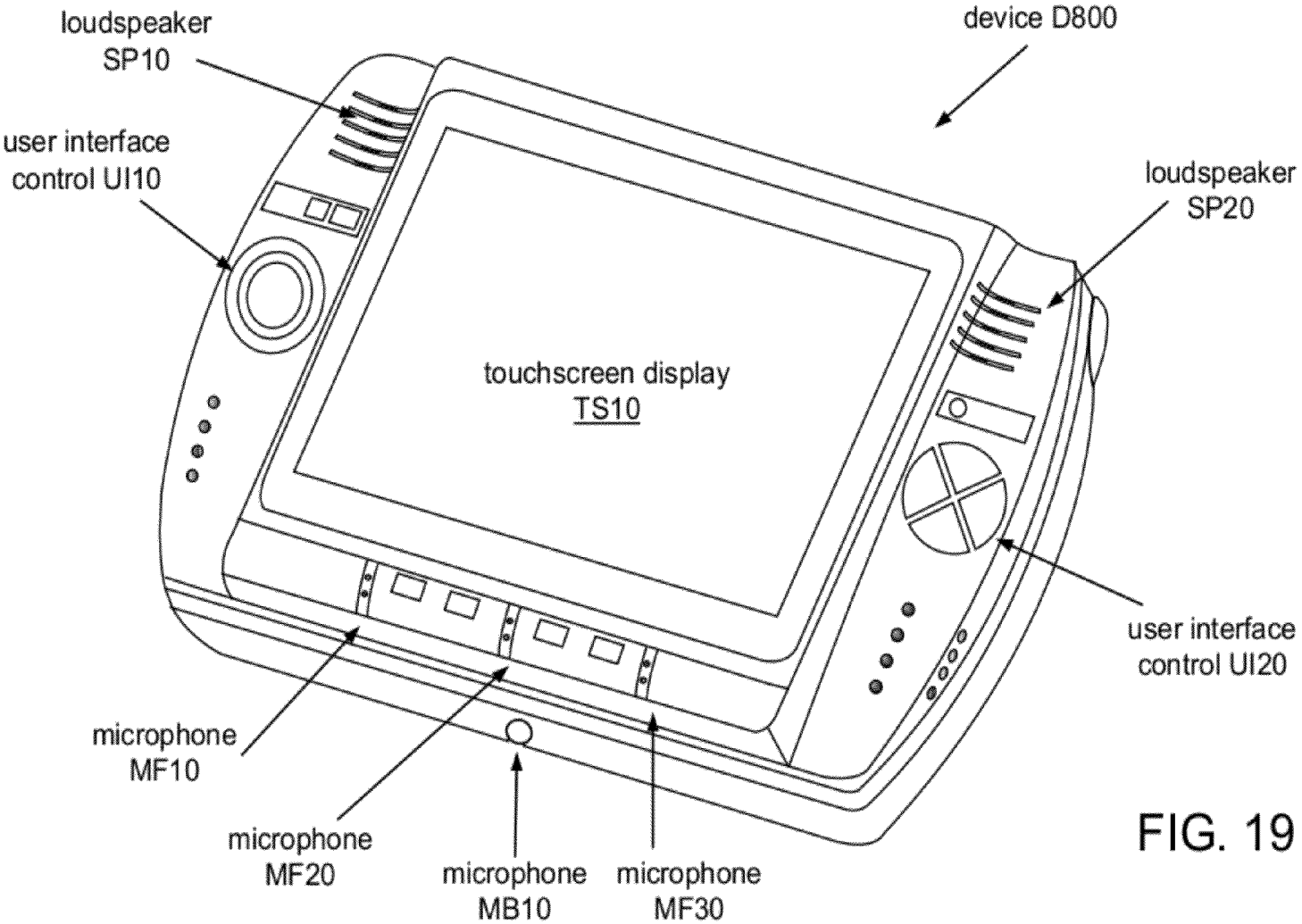
FIG. 19 shows a handheld device D800.
Figure 20B:
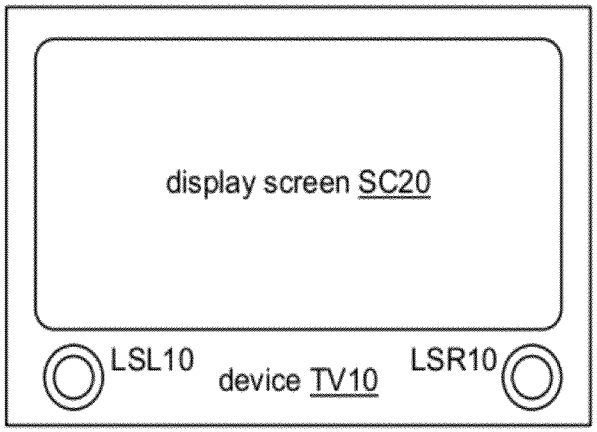
FIG. 20B shows a display device TV10.
Figure 20C:
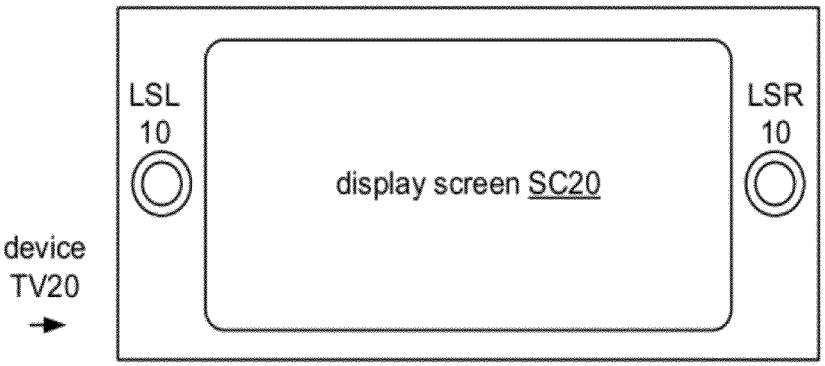
FIG. 20C shows a display device TV20.
Figure 20A:
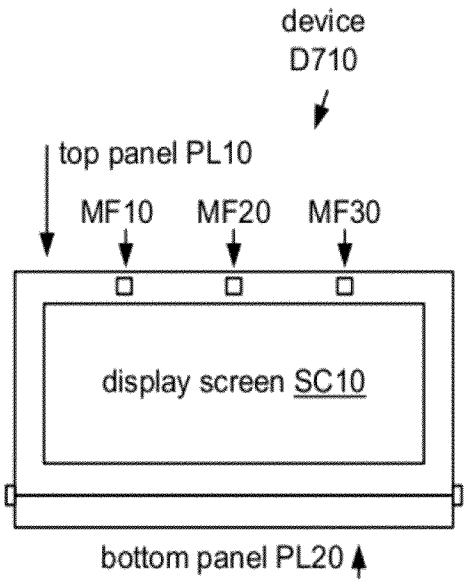
FIG. 20A shows a front view of a laptop computer D710.

In a multi-microphone setup as shown in FIG. 1B, microphones ML10 and MR10 will move with the head, while reference microphone MC10 on the headset cord CD10 (or, alternatively, on a device to which the headset is attached, such as a portable media player D400), will be relatively stationary to the body and not move with the head. For other examples, such as a case in which reference microphone MC10 is in a device that is worn or held by the user, or a case in which reference microphone MC10 is in a device that is resting on another surface, the location of reference microphone MC10 may be invariant to rotation of the user's head. Examples of devices that may include reference microphone MC10 include handset H100 as shown in FIG. 18 (e.g., as one among microphones MF10, MF20, MF30, MB10, and MB20, such as MF30), handheld device D800 as shown in FIG. 19 (e.g., as one among microphones MF10, MF20, MF30, and MB10, such as MF20), and laptop computer D710 as shown in FIG. 20A (e.g., as one among microphones MF10, MF20, and MF30, such as MF20). As the user rotates his or her head, the audio signal cross-correlation (including delay) between microphone MC10 and each of the microphones ML10 and MR10 will change accordingly, such that the minute movements can be tracked and updated in real time.

Figure 7:
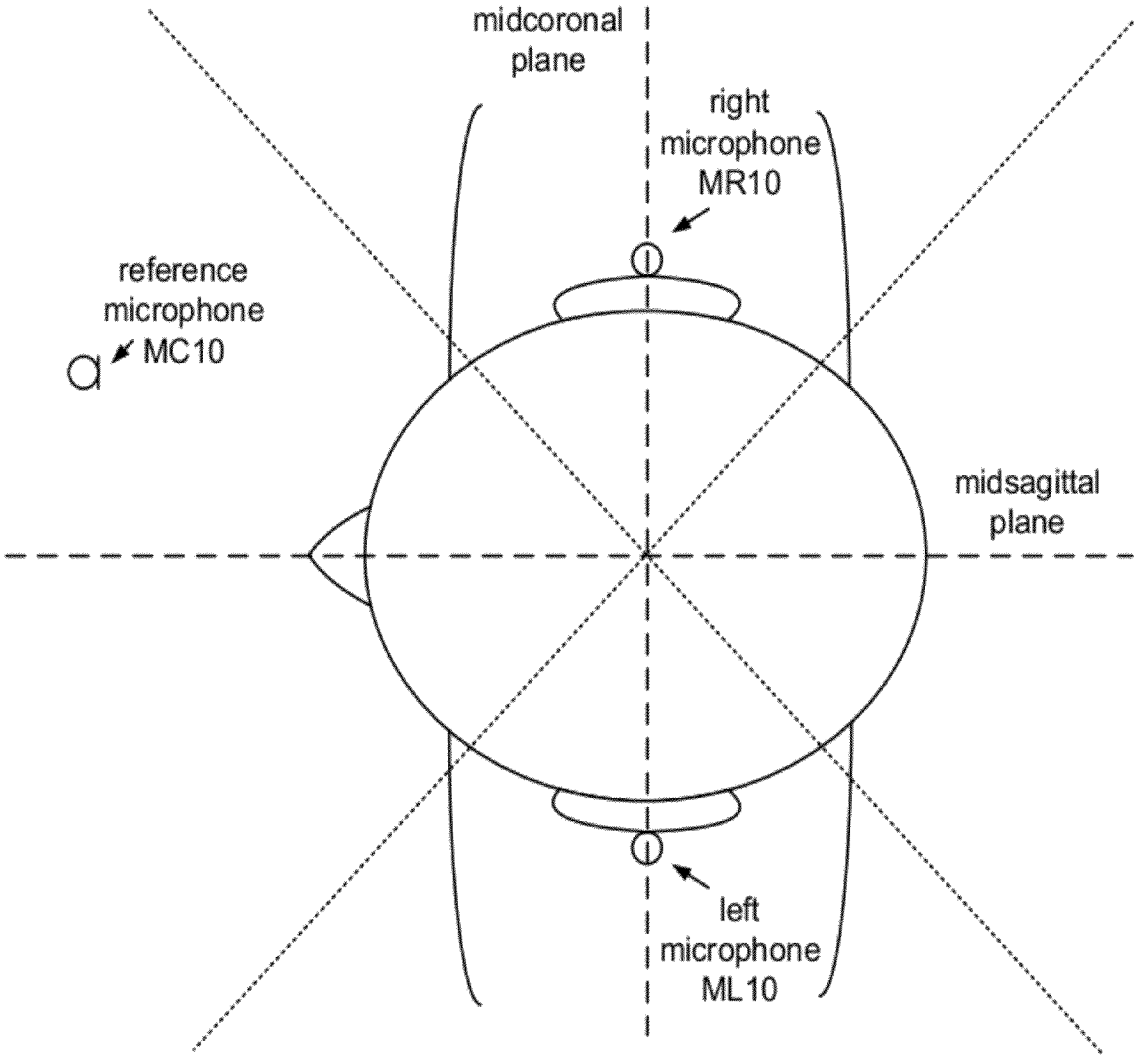
FIG. 7 shows a location of reference microphone MC10 relative to the midsagittal and midcoronal planes of the user's body.

It may be desirable for reference microphone MC10 to be located closer to the midsagittal plane of the user's body than to the midcoronal plane (e.g, as shown in FIG. 7), as the direction of rotation is ambiguous around an orientation in which all three of the microphones are in the same line. Reference microphone MC10 is typically located in front of the user, but reference microphone MC10 may also be located behind the user's head (e.g., in a headrest of a vehicle seat).

It may be desirable for reference microphone MC10 to be close to the left and right microphones. For example, it may be desirable for the distance between reference microphone MC10 and at least the closest among left microphone ML10 and right microphone MR10 to be less than the wavelength of the sound signal, as such a relation may be expected to produce a better cross-correlation result. Such an effect is not obtained with a typical ultrasonic head tracking system, in which the wavelength of the ranging signal is less than two centimeters. It may be desirable for at least half of the energy of each of the left, right, and reference microphone signals to be at frequencies not greater than fifteen hundred Hertz. For example, each signal may be filtered by a lowpass filter to attenuate higher frequencies.

The cross-correlation result may also be expected to improve as the distance between reference microphone MC10 and left microphone ML10 or right microphone MR10 decreases during head rotation. Such an effect is not possible with a two-microphone head tracking system, as the distance between the two microphones is constant during head rotation in such a system.

For a three-microphone head tracking system as described herein, ambient noise and sound can usually be used as the reference audio for the update of the microphone cross-correlation and thus rotation detection. The ambient sound field may include one or more directional sources. For use of the system with a loudspeaker array that is stationary with respect to the user, for example, the ambient sound field may include the field produced by the array. However, the ambient sound field may also be background noise, which may be spatially distributed. In a practical environment, sound absorbers will be nonuniformly distributed, and some non-diffuse reflections will occur, such that some directional flow of energy will exist in the ambient sound field.

Figure 8A:
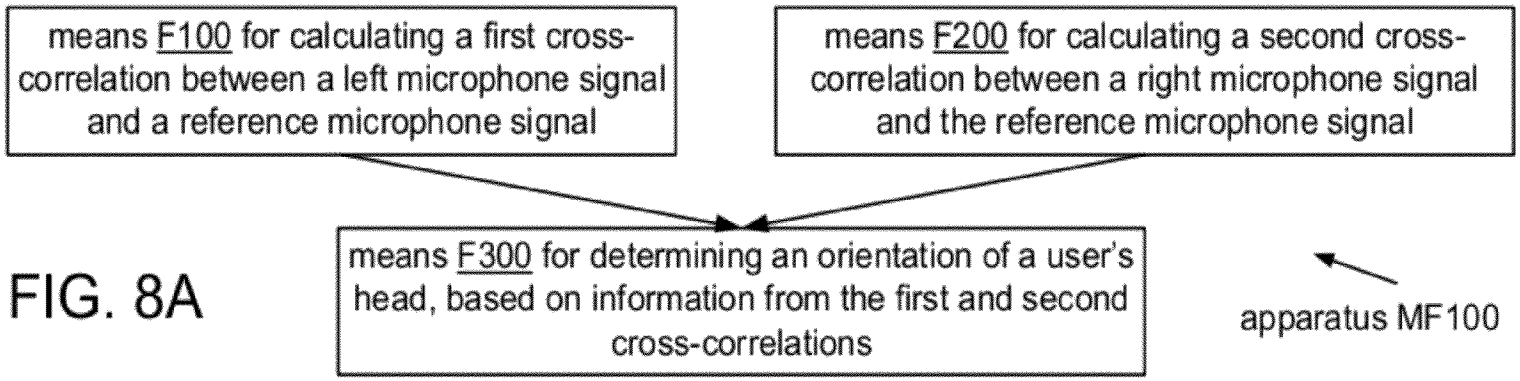
FIG. 8A shows a block diagram of an apparatus MF100 according to a general configuration.
Figure 9A:
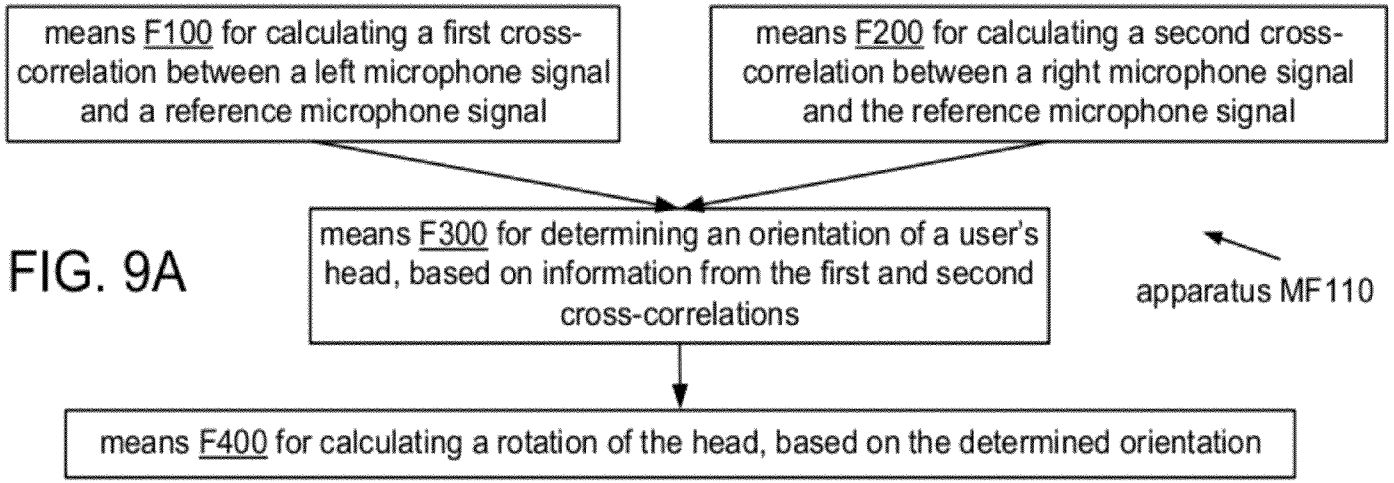
FIG. 9A shows a block diagram of an implementation MF110 of apparatus MF100.

FIG. 8A shows a block diagram of an apparatus MF100 according to a general configuration. Apparatus MF100 includes means F100 for calculating a first cross-correlation between a left microphone signal and a reference microphone signal (e.g., as described herein with reference to task T100). Apparatus MF100 also includes means F200 for calculating a second cross-correlation between a right microphone signal and the reference microphone signal (e.g., as described herein with reference to task T200). Apparatus MF100 also includes means F300 for determining a corresponding orientation of a head of a user, based on information from the first and second calculated cross-correlations (e.g., as described herein with reference to task T300). FIG. 9A shows a block diagram of an implementation MF110 of apparatus MF100 that includes means F400 for calculating a rotation of the head, based on the determined orientation (e.g., as described herein with reference to task T400).

Figure 8B:
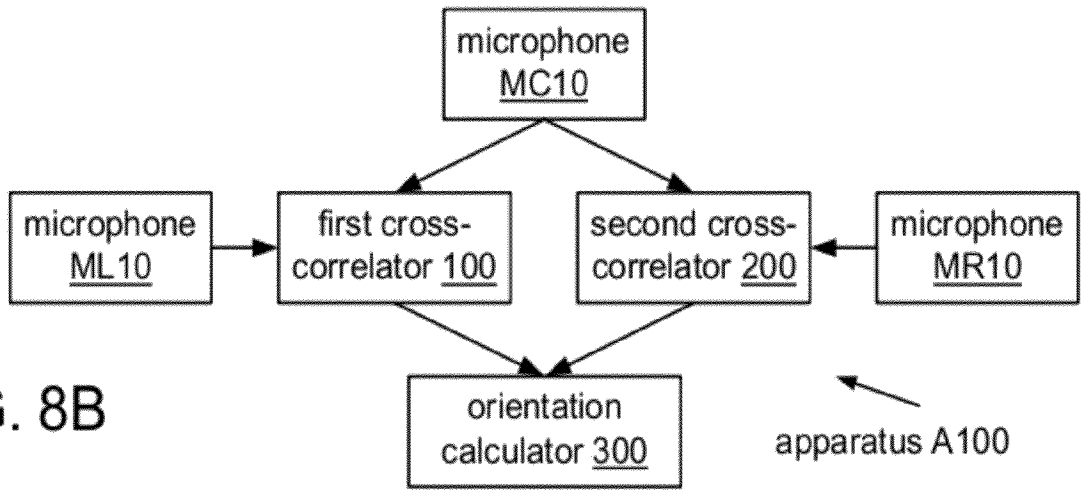
FIG. 8B shows a block diagram of an apparatus A100 according to another general configuration.
Figure 9B:
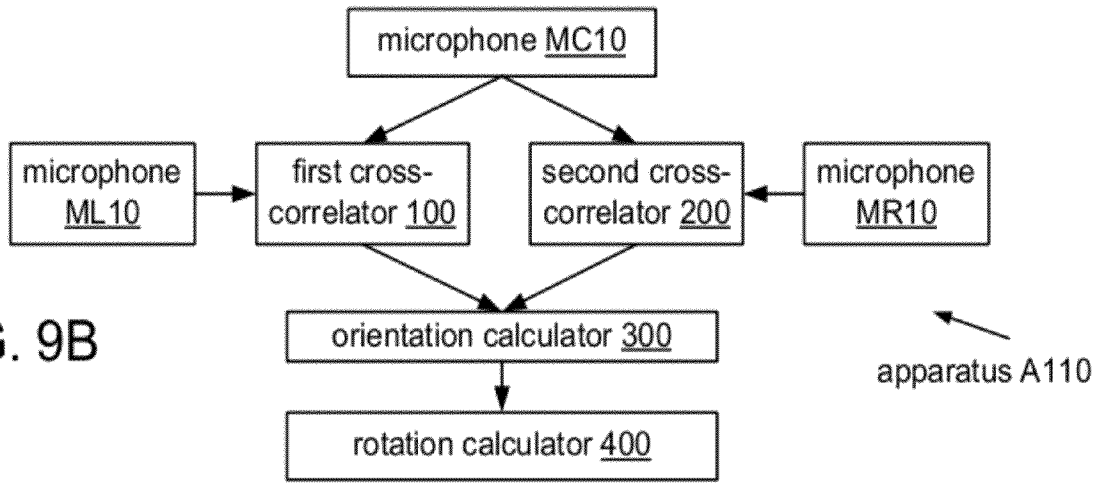
FIG. 9B shows a block diagram of an implementation A110 of apparatus A100.

FIG. 8B shows a block diagram of an apparatus A100 according to another general configuration that includes instances of left microphone ML10, right microphone MR10, and reference microphone MC10 as described herein. Apparatus A100 also includes a first cross-correlator 100 configured to calculate a first cross-correlation between a left microphone signal and a reference microphone signal (e.g., as described herein with reference to task T100), a second cross-correlator 200 configured to calculate a second cross-correlation between a right microphone signal and the reference microphone signal (e.g., as described herein with reference to task T200), and an orientation calculator 300 configured to determine a corresponding orientation of a head of a user, based on information from the first and second calculated cross-correlations (e.g., as described herein with reference to task T300). FIG. 9B shows a block diagram of an implementation A110 of apparatus A100 that includes a rotation calculator 400 configured to calculate a rotation of the head, based on the determined orientation (e.g., as described herein with reference to task T400).

Virtual 3D sound reproduction may include inverse filtering based on an acoustic transfer function, such as a head-related transfer function (HRTF). In such a context, head tracking is typically a desirable feature that may help to support consistent sound image reproduction. For example, it may be desirable to perform the inverse filtering by selecting among a set of fixed inverse filters, based on results of head position tracking. In another example, head position tracking is performed based on analysis of a sequence of images captured by a camera. In a further example, head tracking is performed based on indications from one or more head-mounted orientation sensors (e.g., accelerometers, gyroscopes, and/or magnetometers as described in U.S. patent application Ser. No. 13/280,211, entitled "SYSTEMS, METHODS, APPARATUS, AND COMPUTER-READABLE MEDIA FOR ORIENTATION-SENSITIVE RECORDING CONTROL"). One or more such orientation sensors may be mounted, for example, within an earcup of a pair of earcups as shown in FIG. 2A and/or on band BD10.

Figure 10:
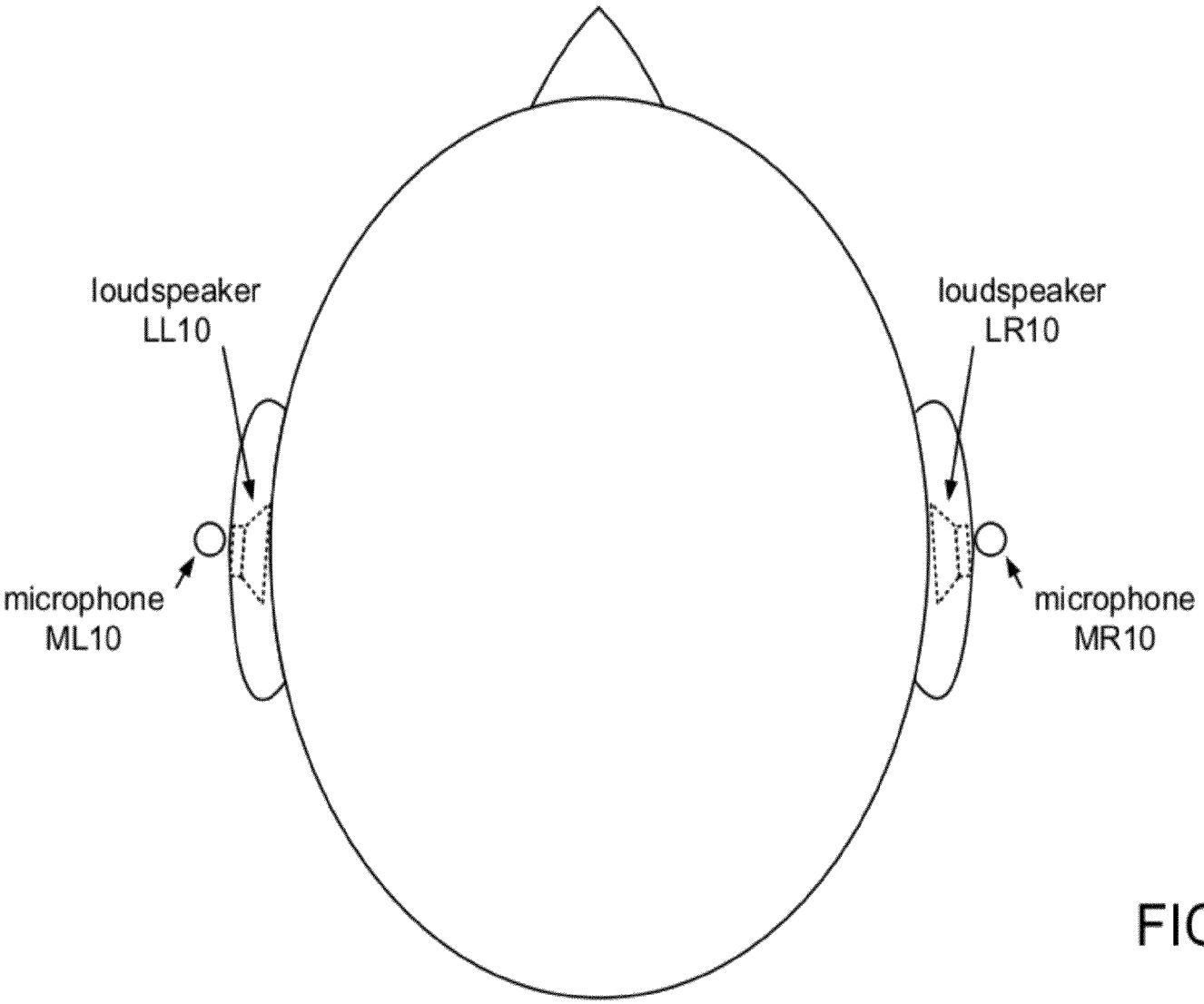
FIG. 10 shows a top view of an arrangement that includes microphone array ML10-MR10 and a pair of head-mounted loudspeakers LL10 and LR10.
Figure 11C:
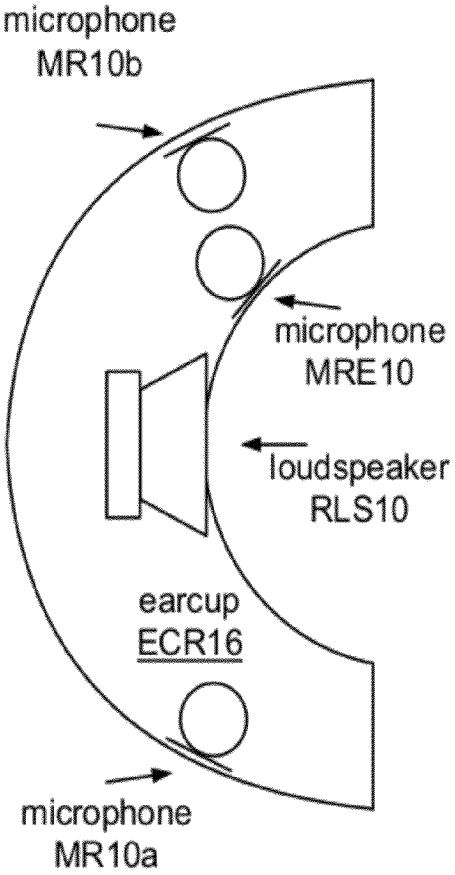
FIGS. 11A to 12C show horizontal cross-sections of implementations ECR12, ECR14, ECR16, ECR22, ECR24, and ECR26, respectively, of earcup ECR10.
Figure 11B:
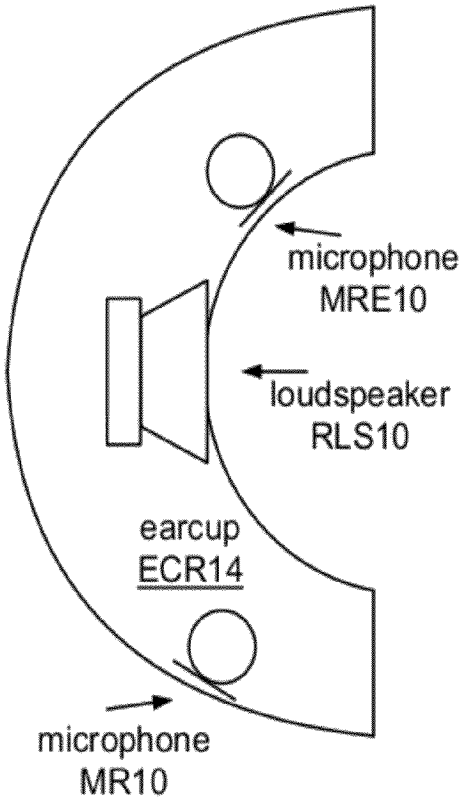
Figure 11A:
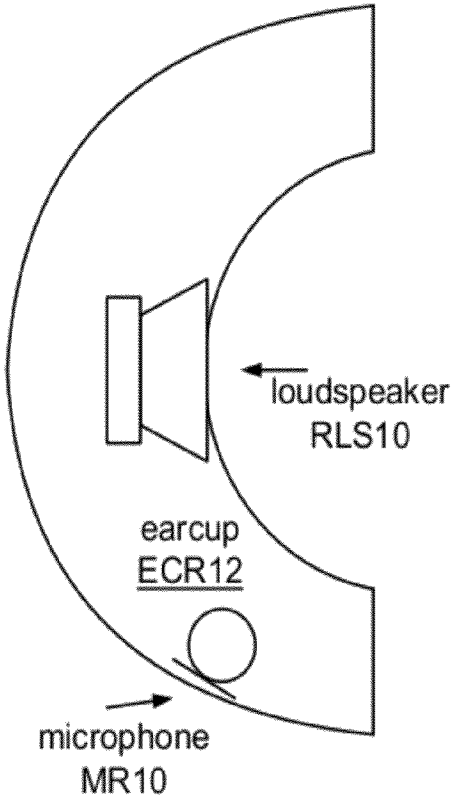
Figure 12A:
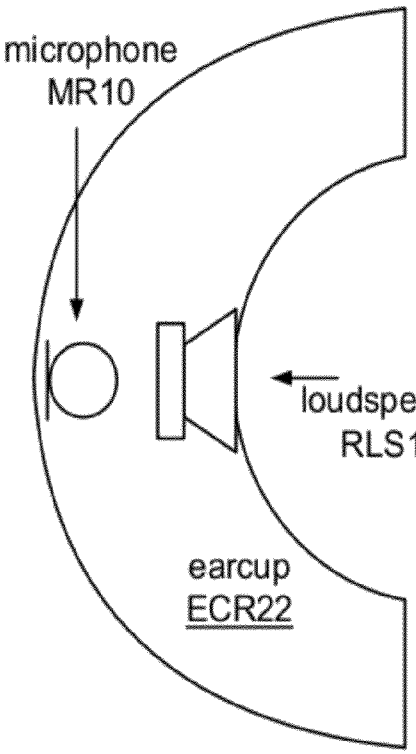
Figure 12B:
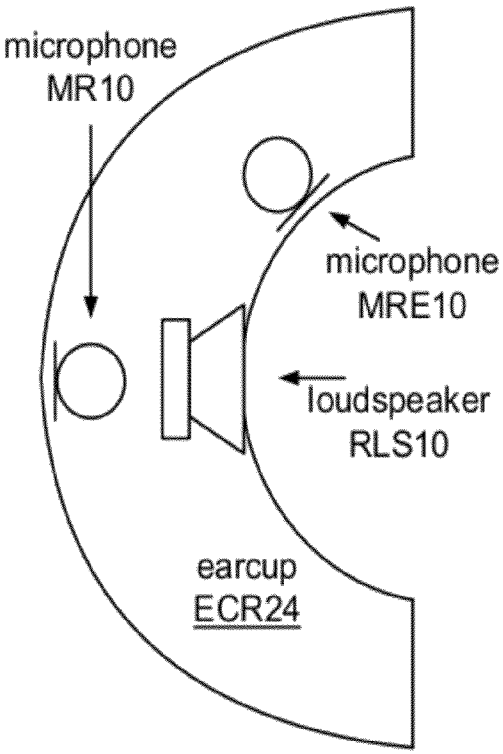
Figure 12C:
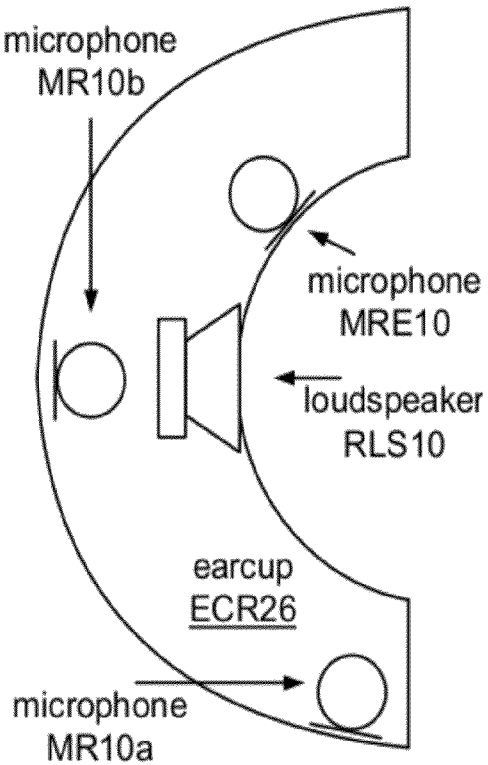

It is generally assumed that a far-end user listens to recorded spatial sound using a pair of head-mounted loudspeakers. Such a pair of loudspeakers includes a left loudspeaker worn on the head to move with a left ear of the user, and a right loudspeaker worn on the head to move with a right ear of the user. FIG. 10 shows a top view of an arrangement that includes microphone array ML10-MR10 and such a pair of head-mounted loudspeakers LL10 and LR10, and the various carriers of microphone array ML10-MR10 as described above may also be implemented to include such an array of two or more loudspeakers.

For example, FIGS. 11A to 12C show horizontal cross-sections of implementations ECR12, ECR14, ECR16, ECR22, ECR24, and ECR26, respectively, of earcup ECR10 that include such a loudspeaker RLS10 that is arranged to produce an acoustic signal to the user's ear (e.g., from a signal received wirelessly or via a cord to a telephone handset or a media playback or streaming device). It may be desirable to insulate the microphones from receiving mechanical vibrations from the loudspeaker through the structure of the earcup. Earcup ECR10 may be configured to be supra-aural (i.e., to rest over the user's ear during use without enclosing it) or circumaural (i.e., to enclose the user's ear during use). Some of these implementations also include an error microphone MRE10 that may be used to support active noise cancellation (ANC) and/or a pair of loudspeakers MR10*a*, MR10*b* that may be used to support near-end and/or far-end noise reduction operations as noted above. (It will be understood that left-side instances of the various right-side earcups described herein are configured analogously.)

Figure 13A:
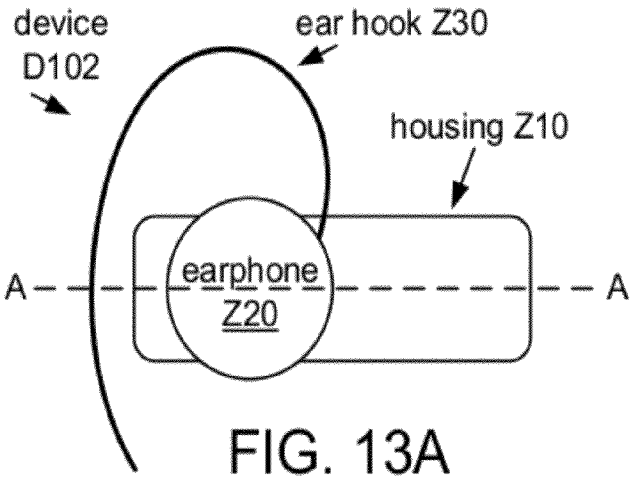
FIGS. 13A to 13D show various views of an implementation D102 of headset D100.
Figure 13B:
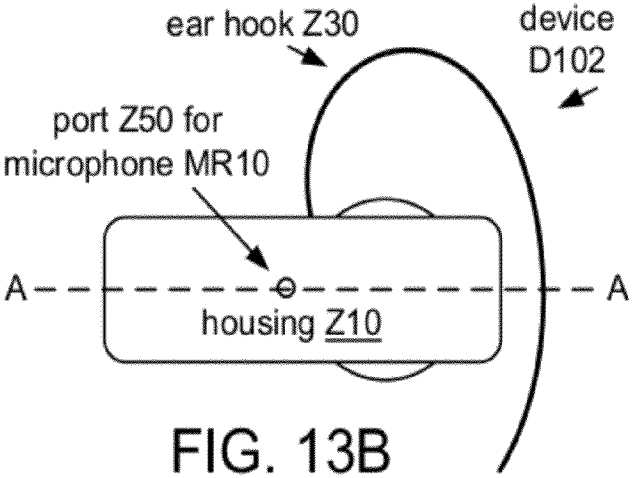
Figure 13C:
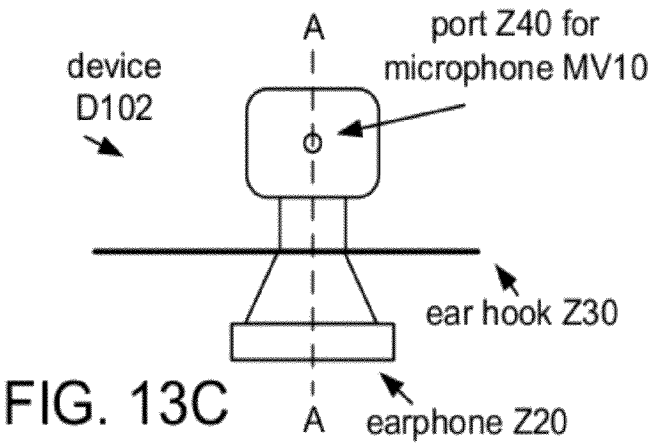
Figure 13D:
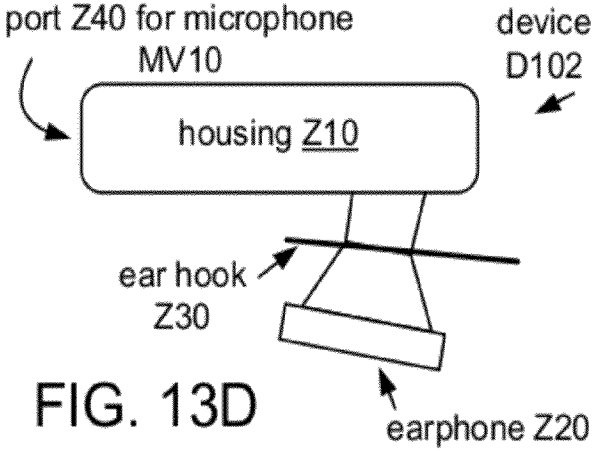

FIGS. 13A to 13D show various views of an implementation D102 of headset D100 that includes a housing Z10 which carries microphones MR10 and MV10 and an earphone Z20 that extends from the housing to direct sound from an internal loudspeaker into the ear canal. Such a device may be configured to support half- or full-duplex telephony via communication with a telephone device such as a cellular telephone handset (e.g., using a version of the Bluetooth™ protocol as promulgated by the Bluetooth Special Interest Group, Inc., Bellevue, Wash.). In general, the housing of a headset may be rectangular or otherwise elongated as shown in FIGS. 13A, 13B, and 13D (e.g., shaped like a miniboom) or may be more rounded or even circular. The housing may also enclose a battery and a processor and/or other processing circuitry (e.g., a printed circuit board and components mounted thereon) and may include an electrical port (e.g., a mini-Universal Serial Bus (USB) or other port for battery charging) and user interface features such as one or more button switches and/or LEDs. Typically the length of the housing along its major axis is in the range of from one to three inches.

Typically each microphone of the headset is mounted within the device behind one or more small holes in the housing that serve as an acoustic port. FIGS. 13B to 13D show the locations of the acoustic port Z40 for microphone MV10 and the acoustic port Z50 for microphone MR10.

Figure 15:
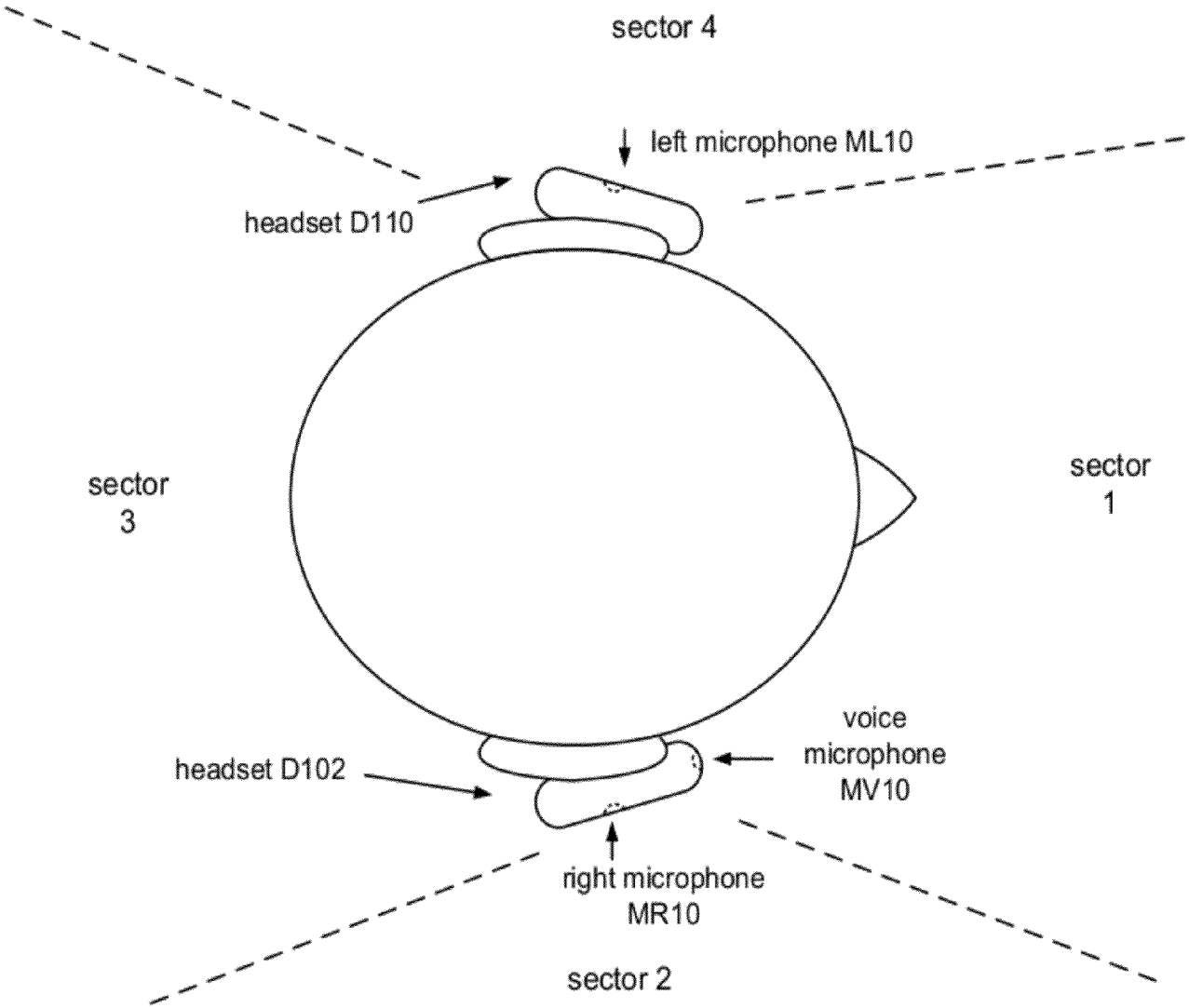
FIG. 15 shows a use of microphones ML10, MR10, and MV10.

A headset may also include a securing device, such as ear hook Z30, which is typically detachable from the headset. An external ear hook may be reversible, for example, to allow the user to configure the headset for use on either ear. Alternatively, the earphone of a headset may be designed as an internal securing device (e.g., an earplug) which may include a removable earpiece to allow different users to use an earpiece of different size (e.g., diameter) for better fit to the outer portion of the particular user's ear canal. FIG. 15 shows a use of microphones ML10, MR10, and MV10 to distinguish among sounds arriving from four different spatial sectors.

Figure 14A:
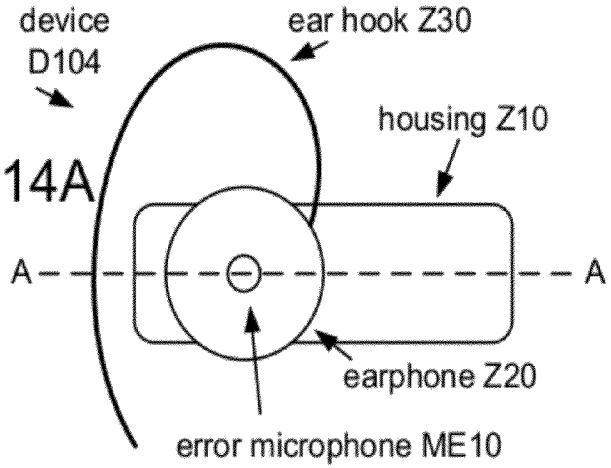
FIG. 14A shows an implementation D104 of headset D100.
Figure 14B:
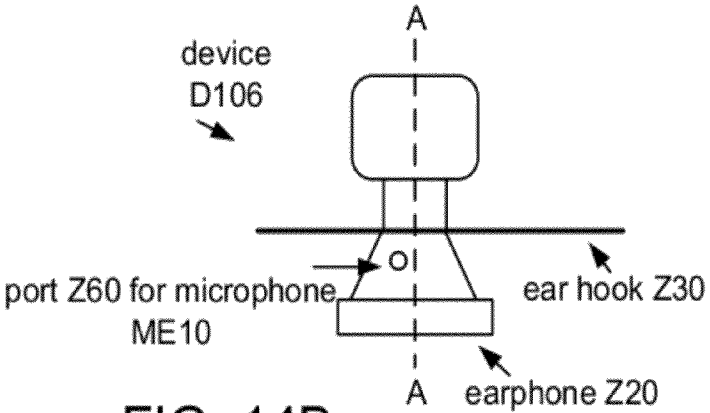
FIG. 14B shows a view of an implementation D106 of headset D100.

FIG. 14A shows an implementation D104 of headset D100 in which error microphone ME10 is directed into the ear canal. FIG. 14B shows a view, along an opposite direction from the view in FIG. 13C, of an implementation D106 of headset D100 that includes a port Z60 for error microphone ME10. (It will be understood that left-side instances of the various right-side headsets described herein may be configured similarly to include a loudspeaker positioned to direct sound into the user's ear canal.)

Figure 14C:
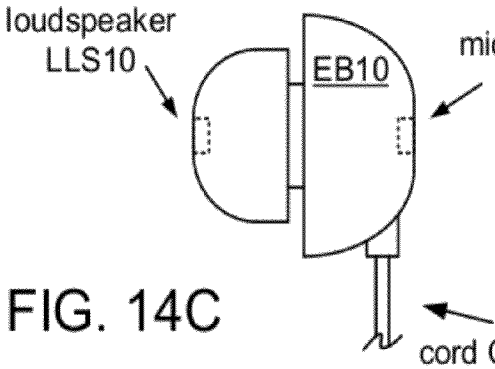
FIG. 14C shows a front view of an example of an earbud EB10.
Figure 14D:
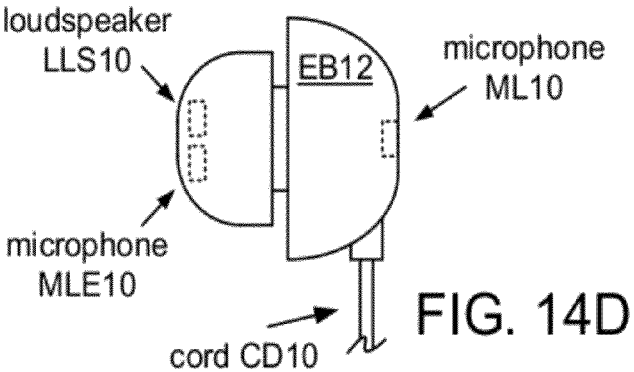
FIG. 14D shows a front view of an implementation EB12 of earbud EB10.

FIG. 14C shows a front view of an example of an earbud EB10 (e.g., as shown in FIG. 1B) that contains a left loudspeaker LLS10 and left microphone ML10. During use, earbud EB10 is worn at the user's left ear to direct an acoustic signal produced by left loudspeaker LLS10 (e.g., from a signal received via cord CD10) into the user's ear canal. It may be desirable for a portion of earbud EB10 which directs the acoustic signal into the user's ear canal to be made of or covered by a resilient material, such as an elastomer (e.g., silicone rubber), such that it may be comfortably worn to form a seal with the user's ear canal. FIG. 14D shows a front view of an implementation EB12 of earbud EB10 that contains an error microphone MLE10 (e.g., to support active noise cancellation). (It will be understood that right-side instances of the various left-side earbuds described herein are configured analogously.)

Head tracking as described herein may be used to rotate a virtual spatial image produced by the head-mounted loudspeakers. For example, it may be desirable to move the virtual image, with respect to an axis of the head-mounted loudspeaker array, according to head movement. In one example, the determined orientation is used to select among stored binaural room transfer functions (BRTFs), which describe the impulse response of the room at each ear, and/or head-related transfer functions (HRTFs), which describe the effect of the head (and possibly the torso) of the user on an acoustic field received by each ear. Such acoustic transfer functions may be calculated offline (e.g., in a training operation) and may be selected to replicate a desired acoustic space and/or may be personalized to the user, respectively. The selected acoustic transfer functions are then applied to the loudspeaker signals for the corresponding ears.

Figure 16A:
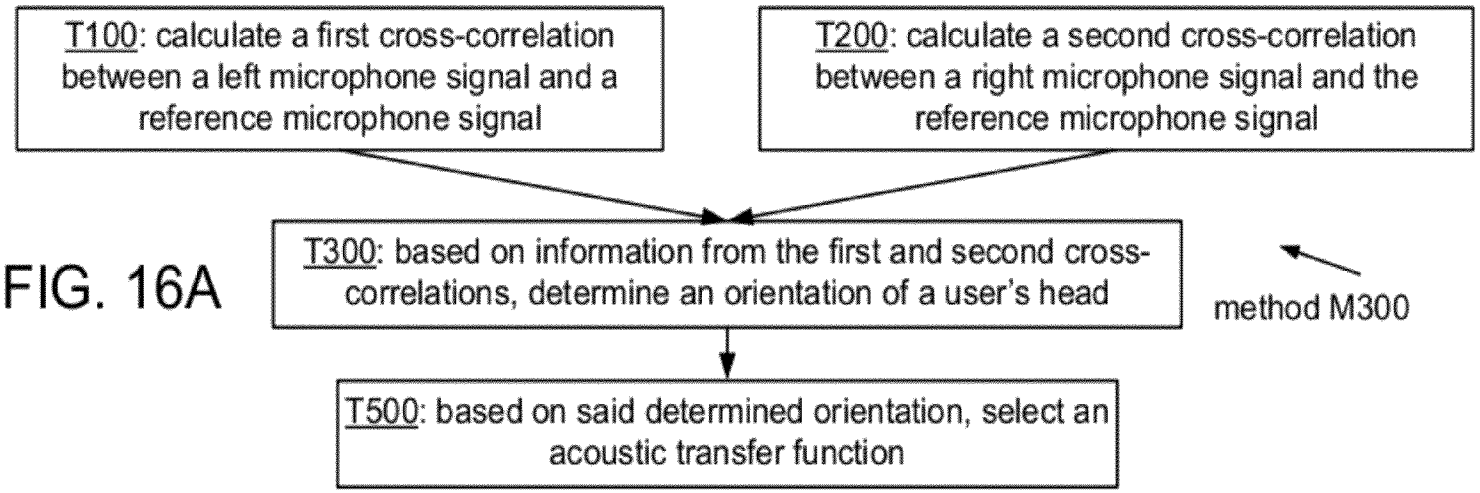
FIG. 16A shows a flowchart for an implementation M300 of method M100.

FIG. 16A shows a flowchart for an implementation M300 of method M100 that includes a task T500. Based on the orientation determined by task T300, task T500 selects an acoustic transfer function. In one example, the selected acoustic transfer function includes a room impulse response. Descriptions of measuring, selecting, and applying room impulse responses may be found, for example, in U.S. Publ. Pat. Appl. No. 2006/0045294 A1 (Smyth).

Figure 16B:
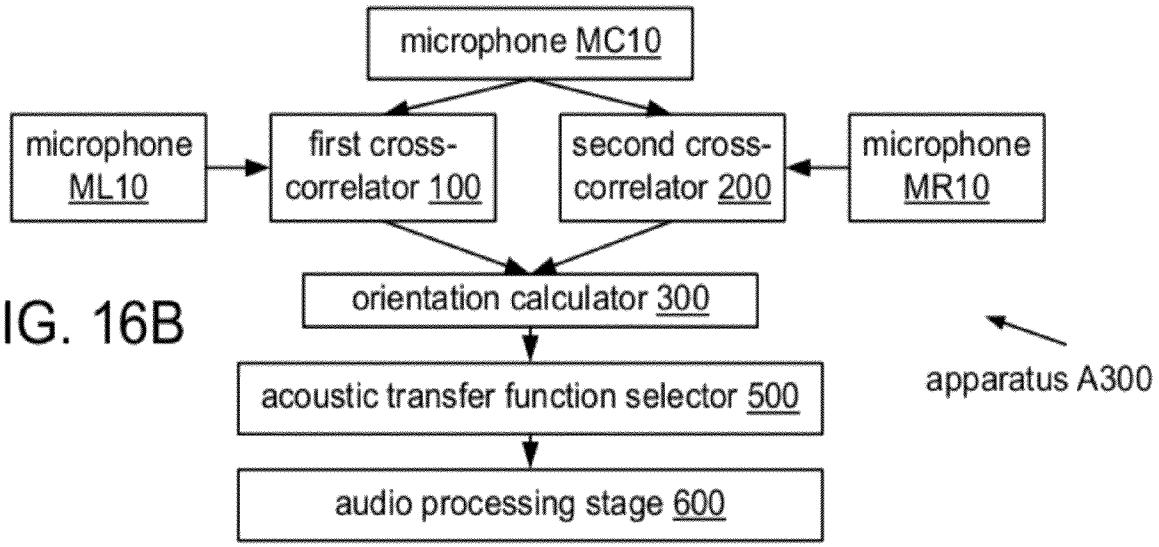
FIG. 16B shows a block diagram of an implementation A300 of apparatus A100.
Figure 17B:
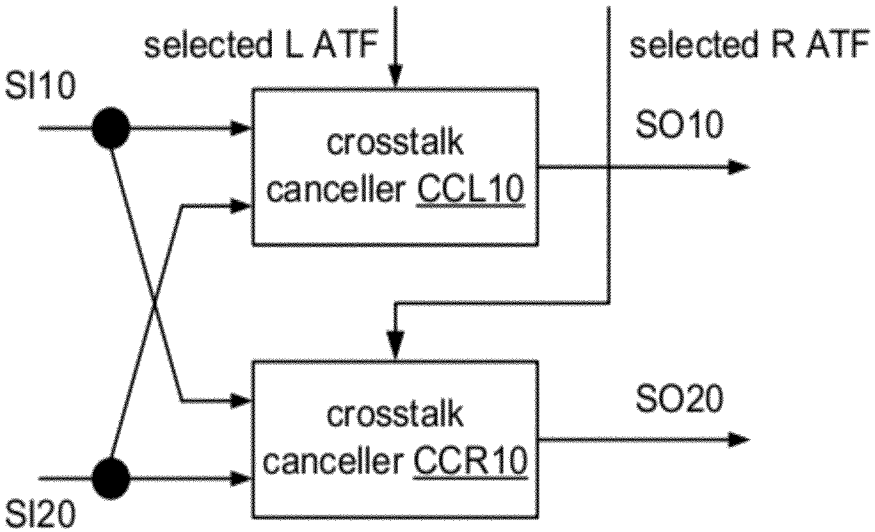
FIG. 17B shows an example of an implementation of audio processing stage 600 as left- and right-channel crosstalk cancellers CCL10, CCR10.
Figure 17A:
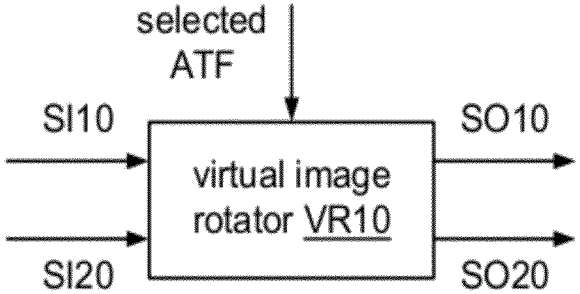
FIG. 17A shows an example of an implementation of audio processing stage 600 as a virtual image rotator VR10.

Method M300 may also be configured to drive a pair of loudspeakers based on the selected acoustic transfer function. FIG. 16B shows a block diagram of an implementation A300 of apparatus A100. Apparatus A300 includes an acoustic transfer function selector 500 that is configured to select an acoustic transfer function (e.g., as described herein with reference to task T500). Apparatus A300 also includes an audio processing stage 600 that is configured to drive a pair of loudspeakers based on the selected acoustic transfer function. Audio processing stage 600 may be configured to produce loudspeaker driving signals 5010, 5020 by converting audio input signals SI10, SI20 from a digital form to an analog form and/or by performing any other desired audio processing operation on the signal (e.g., filtering, amplifying, applying a gain factor to, and/or controlling a level of the signal). Audio input signals SI10, SI20 may be channels of a reproduced audio signal provided by a media playback or streaming device (e.g., a tablet or laptop computer). In one example, audio input signals SI10, SI20 are channels of a far-end communication signal provided by a cellular telephone handset. Audio processing stage 600 may also be configured to provide impedance matching to each loudspeaker. FIG. 17A shows an example of an implementation of audio processing stage 600 as a virtual image rotator VR10.

In other applications, an external loudspeaker array capable of reproducing a sound field in more than two spatial dimensions may be available. FIG. 18 shows an example of such an array LS20L-LS20R in a handset H100 that also includes an earpiece loudspeaker LS10, a touchscreen TS10, and a camera lens L10. FIG. 19 shows an example of such an array SP10-SP20 in a handheld device D800 that also includes user interface controls UI10, UI20 and a touchscreen display TS10. FIG. 20B shows an example of such an array of loudspeakers LSL10-LSR10 below a display screen SC20 in a display device TV10 (e.g., a television or computer monitor), and FIG. 20C shows an example of array LSL10-LSR10 on either side of display screen SC20 in such a display device TV20. A laptop computer D710 as shown in FIG. 20A may also be configured to include such an array (e.g., in behind and/or beside a keyboard in bottom panel PL20 and/or in the margin of display screen SC10 in top panel PL10). Such an array may also be enclosed in one or more separate cabinets or installed in the interior of a vehicle such as an automobile. Examples of spatial audio encoding methods that may be used to reproduce a sound field include 5.1 surround, 7.1 surround, Dolby Surround, Dolby Pro-Logic, or any other phase-amplitude matrix stereo format; Dolby Digital, DTS or any discrete multi-channel format; wavefield synthesis; and the Ambisonic B format or a higher-order Ambisonic format. One example of a five-channel encoding includes Left, Right, Center, Left surround, and Right surround channels.

To widen the perceived spatial image reproduced by a loudspeaker array, a fixed inverse-filter matrix is typically applied to the played-back loudspeaker signals based on a nominal mixing scenario to achieve crosstalk cancellation. However, if the user's head is moving (e.g., rotating), such a fixed inverse-filtering approach may be suboptimal.

It may be desirable to configure method M300 to use the determined orientation to control a spatial image produced by an external loudspeaker array. For example, it may be desirable to implement task T500 to configure a crosstalk cancellation operation based on the determined orientation. Such an implementation of task T500 may include selecting one among a set of HRTFs (e.g., for each channel), according to the determined orientation. Descriptions of selection and use of HRTFs (also called head-related impulse responses or HRIRs) for orientation-dependent crosstalk cancellation may be found, for example, in U.S. Publ. Pat. Appl. No. 2008/0025534 A1 (Kuhn et al.) and U.S. Pat. No. 6,243,476 B1 (Gardner). FIG. 17B shows an example of an implementation of audio processing stage 600 as left- and right-channel crosstalk cancellers CCL10, CCR10.

For a case in which a head-mounted loudspeaker array is used in conjunction with an external loudspeaker array (e.g., an array mounted in a display screen housing, such as a television or computer monitor; installed in a vehicle interior; and/or housed in one or more separate cabinets), rotation of the virtual image as described herein may be performed to maintain alignment of the virtual image with the sound field produced by the external array (e.g., for a gaming or cinema viewing application).

It may be desirable to use information captured by a microphone at each ear (e.g., by microphone array ML10-MR10) to provide adaptive control for faithful audio reproduction in two or three dimensions. When such an array is used in combination with an external loudspeaker array, the headset-mounted binaural recordings can be used to perform adaptive crosstalk cancellation, which allows a robustly enlarged sweet spot for 3D audio reproduction.

In one example, signals produced by microphones ML10 and MR10 in response to a sound field created by the external loudspeaker array are used as feedback signals to update an adaptive filtering operation on the loudspeaker driving signals. Such an operation may include adaptive inverse filtering for crosstalk cancellation and/or dereverberation. It may also be desirable to adapt the loudspeaker driving signals to move the sweet spot as the head moves. Such adaptation may be combined with rotation of a virtual image produced by head-mounted loudspeakers, as described above.

Figure 21:
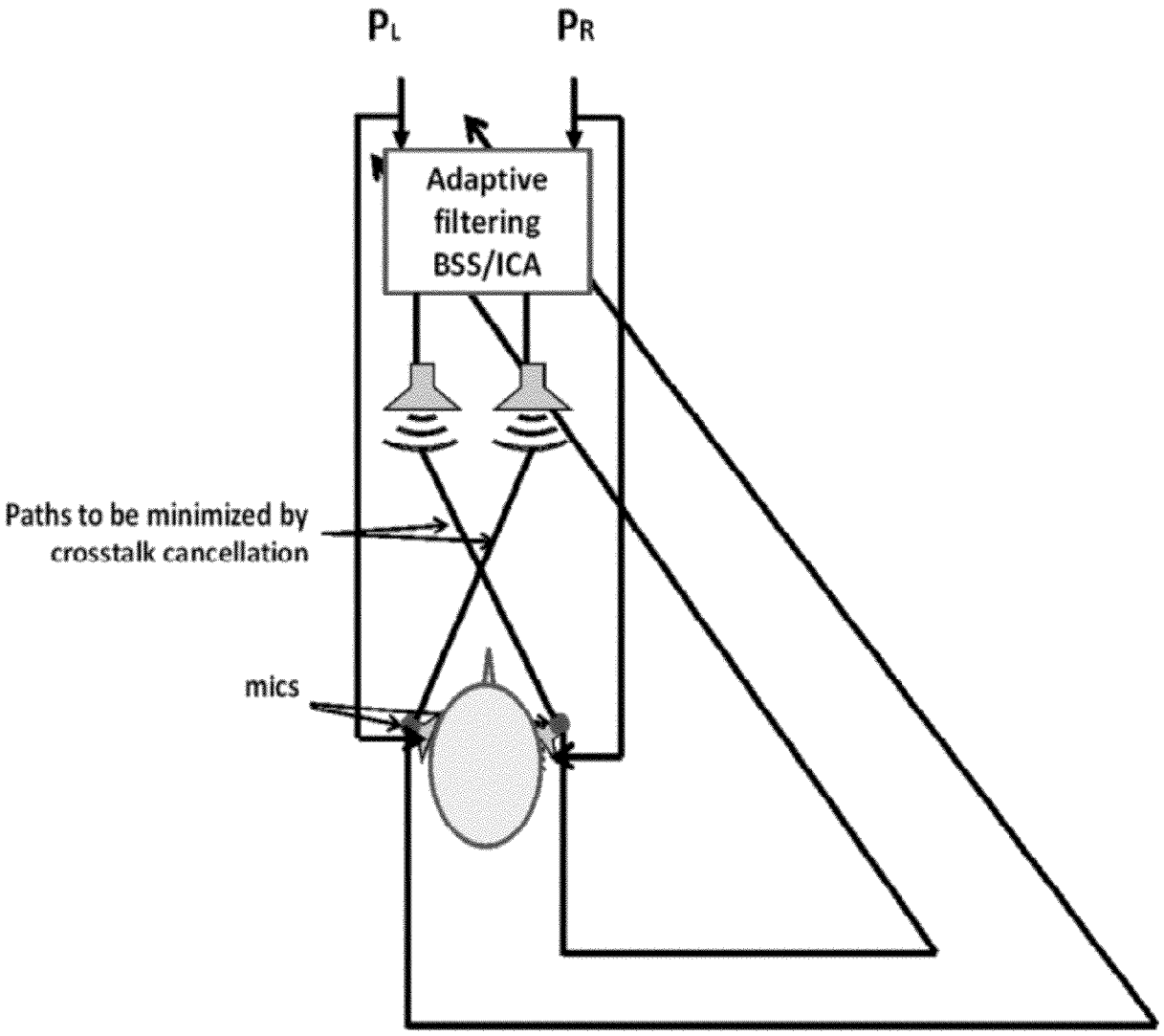
FIG. 21 shows an illustration of a feedback strategy for adaptive crosstalk cancellation.

In an alternative approach to adaptive crosstalk cancellation, feedback information about a sound field produced by a loudspeaker array, as recorded at the level of the user's ears by head-mounted microphones, is used to decorrelate signals produced by the loudspeaker array and thus to achieve a wider spatial image. One proven technique for such a task is based on blind source separation (BSS) techniques. In fact, since the target signals for the near-ear captured signal are also known, any adaptive filtering scheme that converges quickly enough (e.g., similar to an adaptive acoustic echo cancellation scheme) may be applied, such as a least-mean-squares (LMS) technique or an independent component analysis (ICA) technique. FIG. 21 shows an illustration of such a strategy, which can be implemented using a head-mounted microphone array as described herein.

Figure 22A:
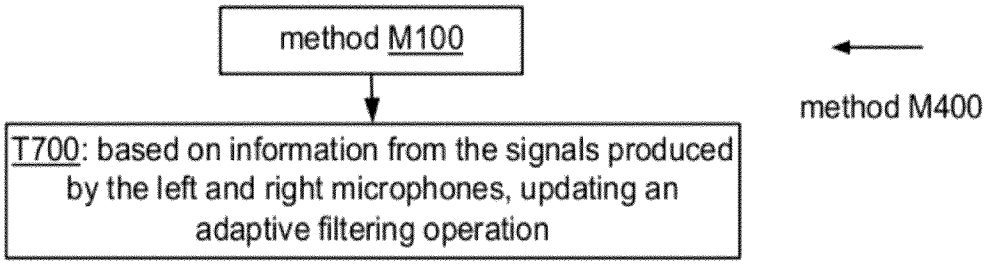
FIG. 22A shows a flowchart of an implementation M400 of method M100.
Figure 22C:
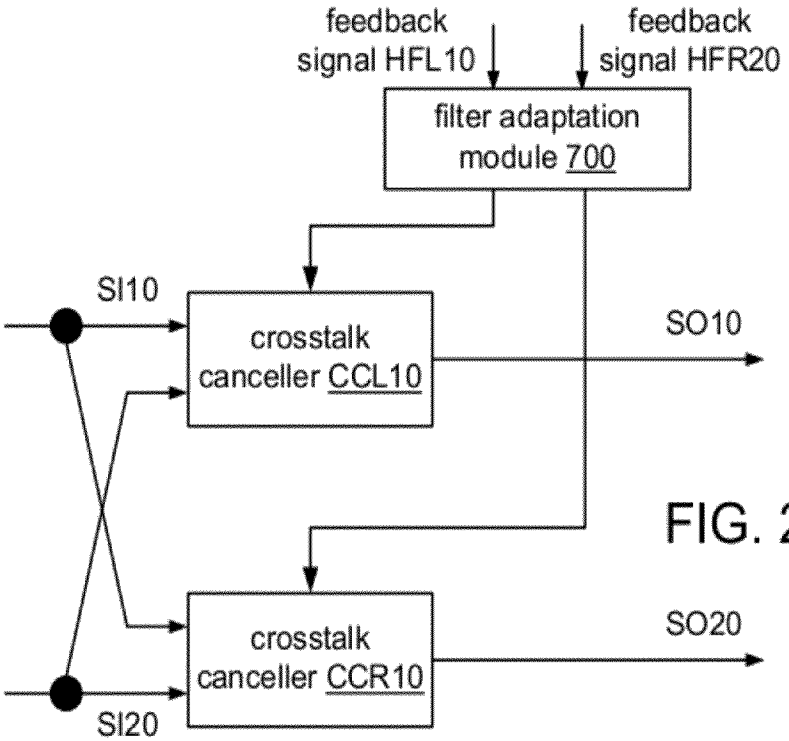
FIG. 22C shows an implementation of audio processing stage 600 as crosstalk cancellers CCL10 and CCR10.
Figure 22B:
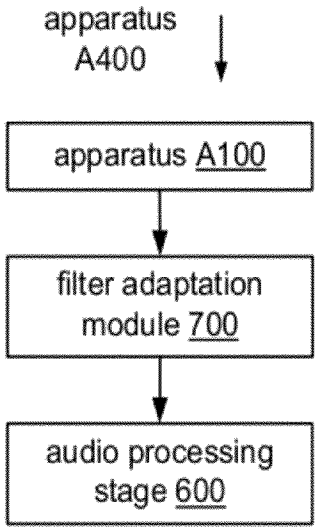
FIG. 22B shows a block diagram of an implementation A400 of apparatus A100.

FIG. 22A shows a flowchart of an implementation M400 of method M100. Method M400 includes a task T700 that updates an adaptive filtering operation, based on information from the signal produced by the left microphone and information from the signal produced by the right microphone. FIG. 22B shows a block diagram of an implementation A400 of apparatus A100. Apparatus A400 includes a filter adaptation module configured to update an adaptive filtering operation, based on information from the signal produced by the left microphone and information from the signal produced by the right microphone (e.g., according to an LMS or ICA technique). Apparatus A400 also includes an instance of audio processing stage 600 that is configured to perform the updated adaptive filtering operation to produce loudspeaker driving signals. FIG. 22C shows an implementation of audio processing stage 600 as a pair of crosstalk cancellers CCL10 and CCR10 whose coefficients are updated by filter adaptation module 700 according to the left and right microphone feedback signals HFL10, HFR10.

Performing adaptive crosstalk cancellation as described above may provide for better source localization. However, adaptive filtering with ANC microphones may also be implemented to include a parameterizable controllability of perceptual parameters (e.g., depth and spaciousness perception) and/or to use actual feedback recorded near the user's ears to provide the appropriate localization perception. Such controllability may be represented, for example, as an easily accessible user interface, especially with a touch-screen device (e.g., a smartphone or a mobile PC, such as a tablet).

Figure 23:
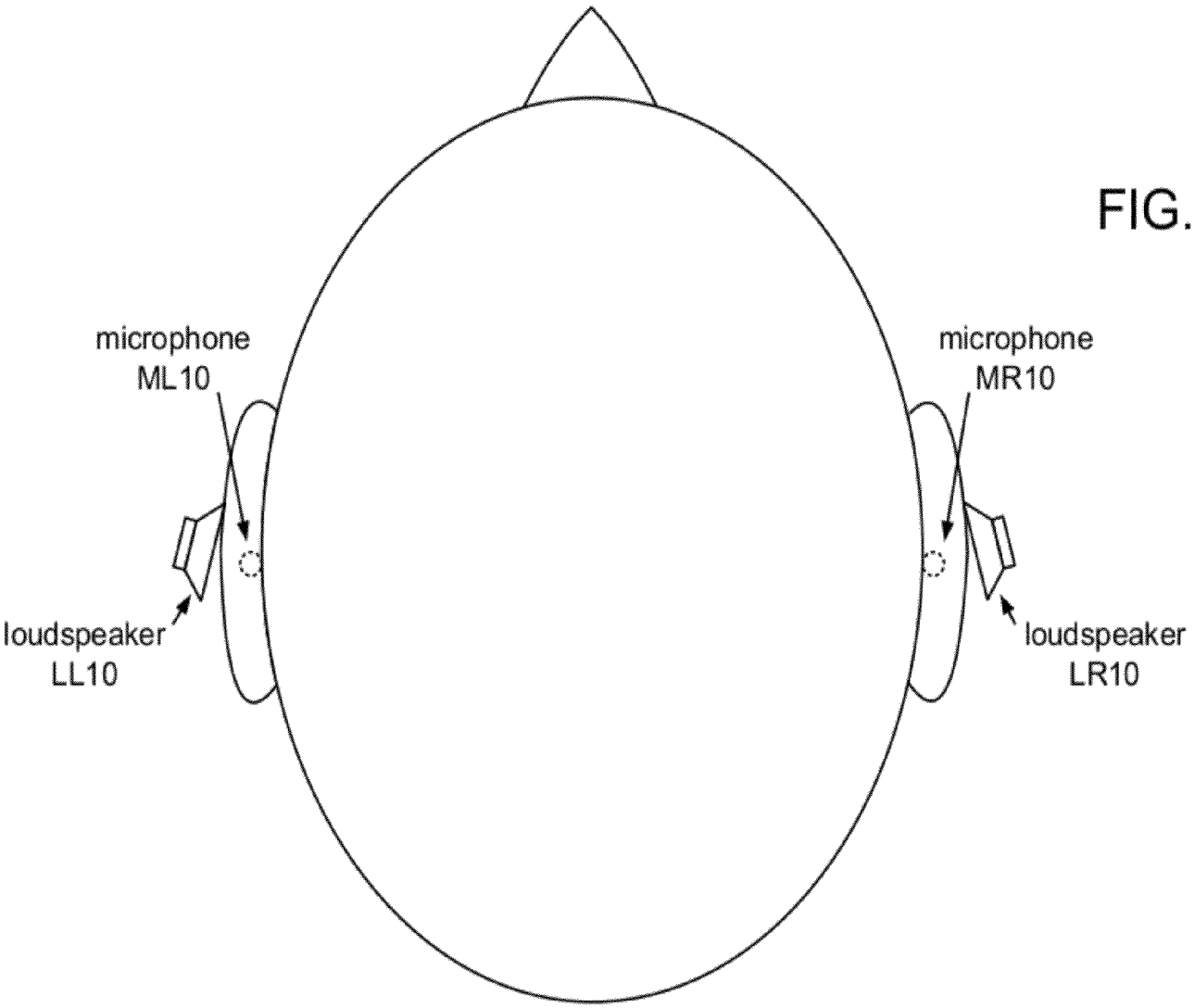
FIG. 23 shows an arrangement of head-mounted loudspeakers and microphones.
Figure 24:
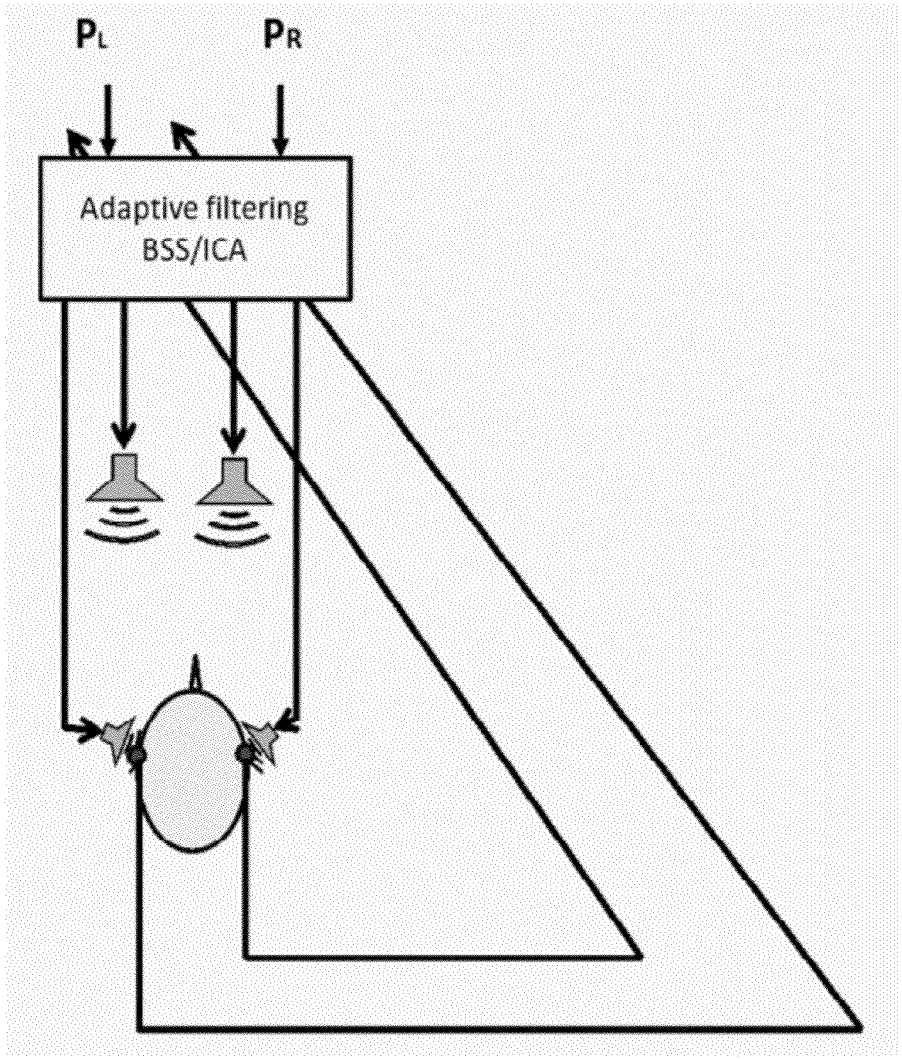
FIG. 24 shows a conceptual diagram for a hybrid 3D audio reproduction scheme.

A stereo headset by itself typically cannot provide as rich a spatial image as externally played loudspeakers, due to different perceptual effects created by inter-cranial sound localization (lateralization) and external sound localization. A feedback operation as shown in FIG. 21 may be used to apply two different 3D audio (head-mounted loudspeaker-based and external-loudspeaker-array-based) reproduction schemes separately. However, we can jointly optimize the two different 3D audio reproduction schemes with a head-mounted arrangement as shown in FIG. 23. Such a structure may be obtained by swapping the positions of the loudspeakers and microphones in the arrangement shown in FIG. 21. Note that with this configuration we can still perform an ANC operation. Additionally, however, we now capture the sound coming not only from the external loudspeaker array but also from the head-mounted loudspeakers LL10 and LR10, and adaptive filtering can be performed for all reproduction paths. Therefore, we can now have clear parameterizable controllability to generate an appropriate sound image near the ears. For example, particular constraints can be applied as well, such that we can rely more on the headphone reproduction for localization perception and rely more on the loudspeaker reproduction for distance and spaciousness perception. FIG. 24 shows a conceptual diagram for a hybrid 3D audio reproduction scheme using such an arrangement.

In this case, a feedback operation may be configured to use signals produced by head-mounted microphones that are located inside of head-mounted loudspeakers (e.g., ANC error microphones as described herein, such as microphone MLE10 and MRE10) to monitor the combined sound field. The signals used to drive the head-mounted loudspeakers may be adapted according to the sound field sensed by the head-mounted microphones. Such an adaptive combination of sound fields may also be used to enhance depth perception and/or spaciousness perception (e.g., by adding reverberation and/or changing the direct-to-reverberant ratio in the external loudspeaker signals), possibly in response to a user selection.

Three-dimensional sound capturing and reproducing with multi-microphone methods may be used to provide features to support a faithful and immersive 3D audio experience. A user or developer can control not only the source locations, but also actual depth and spaciousness perception with predefined control parameters. Automatic auditory scene analysis also enables a reasonable automatic procedure for the default setting, in the absence of a specific indication of the user's intention.

Each of the microphones ML10, MR10, and MC10 may have a response that is omnidirectional, bidirectional, or unidirectional (e.g., cardioid). The various types of microphones that may be used include (without limitation) piezoelectric microphones, dynamic microphones, and electric microphones. It is expressly noted that the microphones may be implemented more generally as transducers sensitive to radiations or emissions other than sound. In one such example, the microphone pair is implemented as a pair of ultrasonic transducers (e.g., transducers sensitive to acoustic frequencies greater than fifteen, twenty, twenty-five, thirty, forty, or fifty kilohertz or more).

Figure 25A:
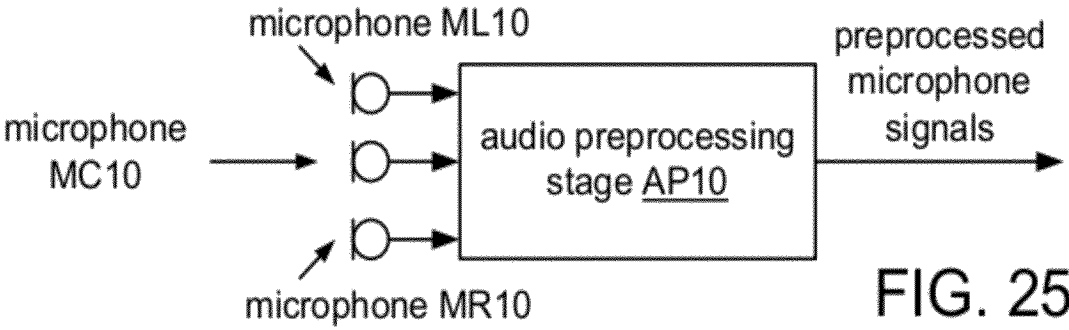
FIG. 25A shows an audio preprocessing stage AP10.

Apparatus A100 may be implemented as a combination of hardware (e.g., a processor) with software and/or with firmware. Apparatus A100 may also include an audio preprocessing stage AP10 as shown in FIG. 25A that performs one or more preprocessing operations on each of the microphone signals ML10, MR10, and MC10 to produce a corresponding one of a left microphone signal AL10, a right microphone signal AR10, and a reference microphone signal AC10. Such preprocessing operations may include (without limitation) impedance matching, analog-to-digital conversion, gain control, and/or filtering in the analog and/or digital domains.

Figure 25B:
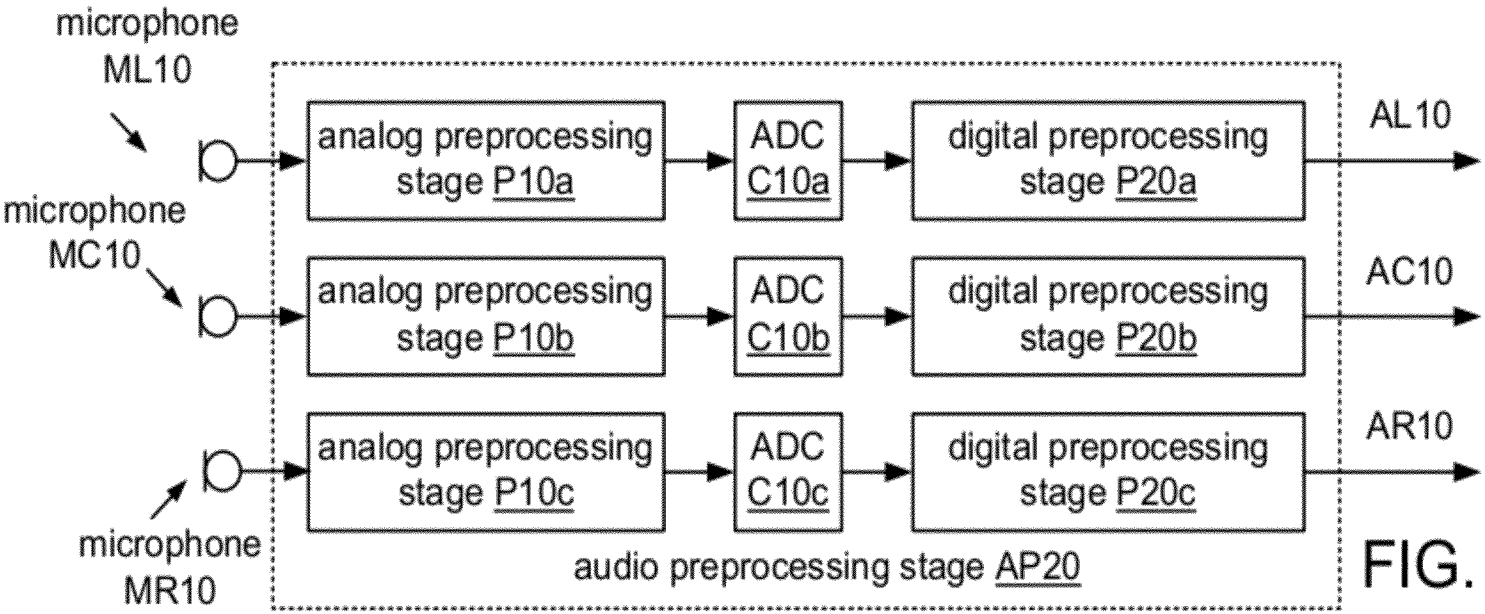
FIG. 25B shows a block diagram of an implementation AP20 of audio preprocessing stage AP10.

FIG. 25B shows a block diagram of an implementation AP20 of audio preprocessing stage AP10 that includes analog preprocessing stages P10*a*, P10*b*, and P10*c*. In one example, stages P10*a*, P10*b*, and P10*c* are each configured to perform a highpass filtering operation (e.g., with a cutoff frequency of 50, 100, or 200 Hz) on the corresponding microphone signal. Typically, stages P10*a*, P10*b*, and P10*c* will be configured to perform the same functions on each signal.

It may be desirable for audio preprocessing stage AP10 to produce each microphone signal as a digital signal, that is to say, as a sequence of samples. Audio preprocessing stage AP20, for example, includes analog-to-digital converters (ADCs) C10*a*, C10*b*, and C10*c* that are each arranged to sample the corresponding analog signal. Typical sampling rates for acoustic applications include 8 kHz, 12 kHz, 16 kHz, and other frequencies in the range of from about 8 to about 16 kHz, although sampling rates as high as about 44.1, 48, or 192 kHz may also be used. Typically, converters C10*a*, C10*b*, and C10*c* will be configured to sample each signal at the same rate.

In this example, audio preprocessing stage AP20 also includes digital preprocessing stages P20*a*, P20*b*, and P20*c* that are each configured to perform one or more preprocessing operations (e.g., spectral shaping) on the corresponding digitized channel. Typically, stages P20*a*, P20*b*, and P20*c* will be configured to perform the same functions on each signal. It is also noted that preprocessing stage AP10 may be configured to produce one version of a signal from each of microphones ML10 and MR10 for cross-correlation calculation and another version for feedback use. Although FIGS. 25A and 25B show two-channel implementations, it will be understood that the same principles may be extended to an arbitrary number of microphones.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, or 44.1, 48, or 192 kHz).

Goals of a multi-microphone processing system may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing for more aggressive noise reduction.

The various elements of an implementation of an apparatus as disclosed herein (e.g., apparatus A100 and MF100) may be embodied in any combination of hardware with software, and/or with firmware, that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a head tracking procedure, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein may be performed by an array of logic elements such as a processor, and that the various elements of an apparatus as described herein may be implemented as modules designed to execute on such an array. As used herein, the term "module" or "submodule" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer storage media and communication media, including any medium that facilitates transfer of a computer program from one place to another. A storage media may be any available media that can be accessed by a computer. By way of example, and not limitation, such computer-readable media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage, magnetic disk storage or other magnetic storage devices, or any other medium that can be used to store desired program code, in the form of instructions or data structures, in tangible structures that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. A method of audio signal processing, said method comprising:

calculating a first cross-correlation between a left microphone signal and a reference microphone signal;

calculating a second cross-correlation between a right microphone signal and the reference microphone signal; and based on information from the first and second calculated cross-correlations, determining a corresponding orientation of a head of a user, wherein the left microphone signal is based on a signal produced by a left microphone located at a left side of the head, the right microphone signal is based on a signal produced by a right microphone located at a right side of the head opposite to the left side, and the reference microphone signal is based on a signal produced by a reference microphone, and wherein said reference microphone is located such that (A) as the head rotates in a first direction, a left distance between the left microphone and the reference microphone decreases and a right distance between the right microphone and the reference microphone increases and (B) as the head rotates in a second direction opposite to the first direction, the left distance increases and the right distance decreases.

2. The method according to claim 1, wherein a line that passes through a center of the left microphone and a center of the right microphone rotates with the head.

3. The method according to claim 1, wherein the left microphone is worn on the head to move with a left ear of the user, and wherein the right microphone is worn on the head to move with a right ear of the user.

4. The method according to claim 1, wherein the left microphone is located not more than five centimeters from an opening of a left ear canal of the user, and wherein the right microphone is located not more than five centimeters from an opening of a right ear canal of the user.

5. The method according to claim 1, wherein said reference microphone is located at a front side of a midcoronal plane of a body of the user.

6. The method according to claim 1, wherein said reference microphone is located closer to a midsagittal plane of a body of the user than to a midcoronal plane of the body of the user.

7. The method according to claim 1, wherein a location of the reference microphone is invariant to rotation of the head.

8. The method according to claim 1, wherein at least half of the energy of each of the left, right, and reference microphone signals is at frequencies not greater than fifteen hundred Hertz.

9. The method according to claim 1, wherein said method includes calculating a rotation of the head, based on said determined orientation.

10. The method according to claim 1, wherein said method includes:

selecting an acoustic transfer function, based on said determined orientation; and driving a pair of loudspeakers based on the selected acoustic transfer function.

11. The method according to claim 10, wherein the selected acoustic transfer function includes a room impulse response.

12. The method according to claim 10, wherein the selected acoustic transfer function includes a head-related transfer function.

13. The method according to claim 10, wherein said driving includes performing a crosstalk cancellation operation that is based on the selected acoustic transfer function.

14. The method according to claim 1, wherein said method comprises:

updating an adaptive filtering operation, based on information from the signal produced by the left microphone and information from the signal produced by the right microphone; and based on the updated adaptive filtering operation, driving a pair of loudspeakers.

15. The method according to claim 14, wherein the signal produced by the left microphone and the signal produced by the right microphone are produced in response to a sound field produced by the pair of loudspeakers.

16. The method according to claim 10, wherein the pair of loudspeakers includes a left loudspeaker worn on the head to move with a left ear of the user, and a right loudspeaker worn on the head to move with a right ear of the user.

17. An apparatus for audio signal processing, said apparatus comprising:

means for calculating a first cross-correlation between a left microphone signal and a reference microphone signal;

means for calculating a second cross-correlation between a right microphone signal and the reference microphone signal; and means for determining a corresponding orientation of a head of a user, based on information from the first and second calculated cross-correlations, wherein the left microphone signal is based on a signal produced by a left microphone located at a left side of the head, the right microphone signal is based on a signal produced by a right microphone located at a right side of the head opposite to the left side, and the reference microphone signal is based on a signal produced by a reference microphone, and wherein said reference microphone is located such that (A) as the head rotates in a first direction, a left distance between the left microphone and the reference microphone decreases and a right distance between the right microphone and the reference microphone increases and (B) as the head rotates in a second direction opposite to the first direction, the left distance increases and the right distance decreases.

18. The apparatus according to claim 17, wherein, during use of the apparatus, a line that passes through a center of the left microphone and a center of the right microphone rotates with the head.

19. The apparatus according to claim 17, wherein the left microphone is configured to be worn, during use of the apparatus, on the head to move with a left ear of the user, and wherein the right microphone is configured to be worn, during use of the apparatus, on the head to move with a right ear of the user.

20. The apparatus according to claim 17, wherein the left microphone is configured to be located, during use of the apparatus, not more than five centimeters from an opening of a left ear canal of the user, and wherein the right microphone is configured to be located, during use of the apparatus, not more than five centimeters from an opening of a right ear canal of the user.

21. The apparatus according to claim 17, wherein said reference microphone is configured to be located, during use of the apparatus, at a front side of a midcoronal plane of a body of the user.

22. The apparatus according to claim 17, wherein said reference microphone is configured to be located, during use of the apparatus, closer to a midsagittal plane of a body of the user than to a midcoronal plane of the body of the user.

23. The apparatus according to claim 17, wherein a location of the reference microphone is invariant to rotation of the head.

24. The apparatus according to claim 17, wherein at least half of the energy of each of the left, right, and reference microphone signals is at frequencies not greater than fifteen hundred Hertz.

25. The apparatus according to claim 17, wherein said apparatus includes means for calculating a rotation of the head, based on said determined orientation.

26. The apparatus according to claim 17, wherein said apparatus includes:

means for selecting one among a set of acoustic transfer functions, based on said determined orientation; and means for driving a pair of loudspeakers based on the selected acoustic transfer function.

27. The apparatus according to claim 26, wherein the selected acoustic transfer function includes a room impulse response.

28. The apparatus according to claim 26, wherein the selected acoustic transfer function includes a head-related transfer function.

29. The apparatus according to claim 26, wherein said means for driving is configured to perform a crosstalk cancellation operation that is based on the selected acoustic transfer function.

30. The apparatus according to claim 17, wherein said apparatus comprises:

means for updating an adaptive filtering operation, based on information from the signal produced by the left microphone and information from the signal produced by the right microphone; and means for driving a pair of loudspeakers based on the updated adaptive filtering operation.

31. The apparatus according to claim 30, wherein the signal produced by the left microphone and the signal produced by the right microphone are produced in response to a sound field produced by the pair of loudspeakers.

32. The apparatus according to claim 26, wherein the pair of loudspeakers includes a left loudspeaker worn on the head to move with a left ear of the user, and a right loudspeaker worn on the head to move with a right ear of the user.

33. An apparatus for audio signal processing, said apparatus comprising:

a left microphone configured to be located, during use of the apparatus, at a left side of a head of a user;

a right microphone configured to be located, during use of the apparatus, at a right side of the head opposite to the left side;

a reference microphone configured to be located, during use of the apparatus, such that (A) as the head rotates in a first direction, a left distance between the left microphone and the reference microphone decreases and a right distance between the right microphone and the reference microphone increases and (B) as the head rotates in a second direction opposite to the first direction, the left distance increases and the right distance decreases;

a first cross-correlator configured to calculate a first cross-correlation between a reference microphone signal that is based on a signal produced by the reference microphone and a left microphone signal that is based on a signal produced by the left microphone;

a second cross-correlator configured to calculate a second cross-correlation between the reference microphone signal and a right microphone signal that is based on a signal produced by the right microphone; and an orientation calculator configured to determine a corresponding orientation of a head of a user, based on information from the first and second calculated cross-correlations.

34. The apparatus according to claim 33, wherein, during use of the apparatus, a line that passes through a center of the left microphone and a center of the right microphone rotates with the head.

35. The apparatus according to claim 33, wherein the left microphone is configured to be worn, during use of the apparatus, on the head to move with a left ear of the user, and wherein the right microphone is configured to be worn, during use of the apparatus, on the head to move with a right ear of the user.

36. The apparatus according to claim 33, wherein the left microphone is configured to be located, during use of the apparatus, not more than five centimeters from an opening of a left ear canal of the user, and wherein the right microphone is configured to be located, during use of the apparatus, not more than five centimeters from an opening of a right ear canal of the user.

37. The apparatus according to claim 33, wherein said reference microphone is configured to be located, during use of the apparatus, at a front side of a midcoronal plane of a body of the user.

38. The apparatus according to claim 33, wherein said reference microphone is configured to be located, during use of the apparatus, closer to a midsagittal plane of a body of the user than to a midcoronal plane of the body of the user.

39. The apparatus according to claim 33, wherein a location of the reference microphone is invariant to rotation of the head.

40. The apparatus according to claim 33, wherein at least half of the energy of each of the left, right, and reference microphone signals is at frequencies not greater than fifteen hundred Hertz.

41. The apparatus according to claim 33, wherein said apparatus includes a rotation calculator configured to calculate a rotation of the head, based on said determined orientation.

42. The apparatus according to claim 33, wherein said apparatus includes:

an acoustic transfer function selector configured to select one among a set of acoustic transfer functions, based on said determined orientation; and an audio processing stage configured to drive a pair of loudspeakers based on the selected acoustic transfer function.

43. The apparatus according to claim 42, wherein the selected acoustic transfer function includes a room impulse response.

44. The apparatus according to claim 42, wherein the selected acoustic transfer function includes a head-related transfer function.

45. The apparatus according to claim 42, wherein said audio processing stage is configured to perform a crosstalk cancellation operation that is based on the selected acoustic transfer function.

46. The apparatus according to claim 33, wherein said apparatus comprises:

a filter adaptation module configured to update an adaptive filtering operation, based on information from the signal produced by the left microphone and information from the signal produced by the right microphone; and an audio processing stage configured to drive a pair of loudspeakers based on the updated adaptive filtering operation.

47. The apparatus according to claim 46, wherein the signal produced by the left microphone and the signal produced by the right microphone are produced in response to a sound field produced by the pair of loudspeakers.

48. The apparatus according to claim 42, wherein the pair of loudspeakers includes a left loudspeaker worn on the head to move with a left ear of the user, and a right loudspeaker worn on the head to move with a right ear of the user.

49. A non-transitory machine-readable storage medium comprising tangible features that when read by a machine cause the machine to:

calculate a first cross-correlation between a left microphone signal and a reference microphone signal;

calculate a second cross-correlation between a right microphone signal and the reference microphone signal; and determine a corresponding orientation of a head of a user, based on information from the first and second calculated cross-correlations, wherein the left microphone signal is based on a signal produced by a left microphone located at a left side of the head, the right microphone signal is based on a signal produced by a right microphone located at a right side of the head opposite to the left side, and the reference microphone signal is based on a signal produced by a reference microphone, and wherein said reference microphone is located such that (A) as the head rotates in a first direction, a left distance between the left microphone and the reference microphone decreases and a right distance between the right microphone and the reference microphone increases and (B) as the head rotates in a second direction opposite to the first direction, the left distance increases and the right distance decreases.

* * * * *